US007664428B2

(12) United States Patent
Kei

(10) Patent No.: US 7,664,428 B2
(45) Date of Patent: Feb. 16, 2010

(54) ELECTROPHOTOGRAPHIC IMAGE FORMING APPARATUS AND PROCESS CARTRIDGE

(75) Inventor: Hidetoshi Kei, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 202 days.

(21) Appl. No.: 12/047,933

(22) Filed: Mar. 13, 2008

(65) Prior Publication Data

US 2009/0092412 A1 Apr. 9, 2009

(30) Foreign Application Priority Data

Oct. 9, 2007 (JP) ..... 2007-263056

(51) Int. Cl.
*G03G 15/00* (2006.01)
*G03G 21/18* (2006.01)

(52) U.S. Cl. ..... 399/110; 399/111

(58) Field of Classification Search ..... 399/110, 399/111

See application file for complete search history.

(56) References Cited

U.S. PATENT DOCUMENTS 7,486,907 B2 2/2009 Noguchi et al. ..... 399/110
2006/0067734 A1 3/2006 Igarashi et al. ..... 399/119
2007/0160385 A1 7/2007 Noguchi et al. ..... 399/110
2009/0047039 A1 2/2009 Noguchi et al. ..... 399/116

FOREIGN PATENT DOCUMENTS

JP A 2000-132069 5/2000
JP 2007-213012 8/2007

OTHER PUBLICATIONS

Japanese Office Action—Notification of Reasons for Refusal issued May 20, 2008, in Japanese Application No. 2007-263056, and English-language translation thereof.
English-language translation of Japanese Office Action dated May 14, 2008, in Japanese Patent Application No. 2007-263056.

*Primary Examiner*—David M Gray
*Assistant Examiner*—G. M. Hyder
(74) *Attorney, Agent, or Firm*—Fitzpatrick, Cella, Harper & Scinto

(57) ABSTRACT

An electrophotographic image forming apparatus to which a process cartridge is detachably mountable, the process cartridge can be positioned with high accuracy in a simple construction in an apparatus main body. The process cartridge is put on a cartridge tray, and the process cartridge is replaced by a front access. Furthermore, the process cartridge is moved in conjunction with opening/closing operations of a door member so that a photosensitive drum and a transfer belt are brought in contact with each other.

14 Claims, 26 Drawing Sheets

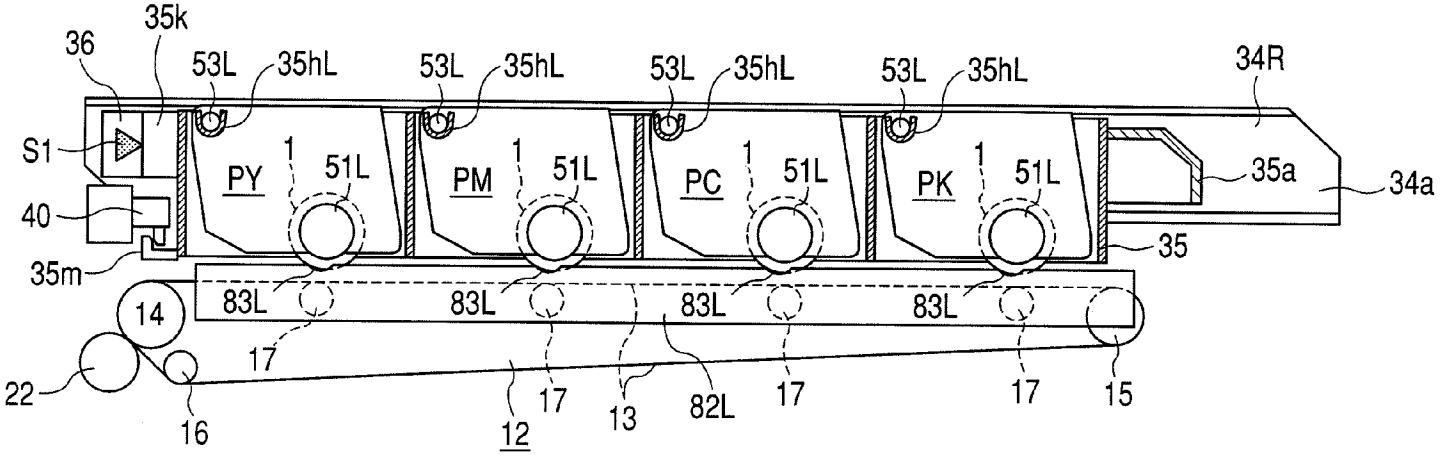
FIG. 19A NON-DRIVE SIDE
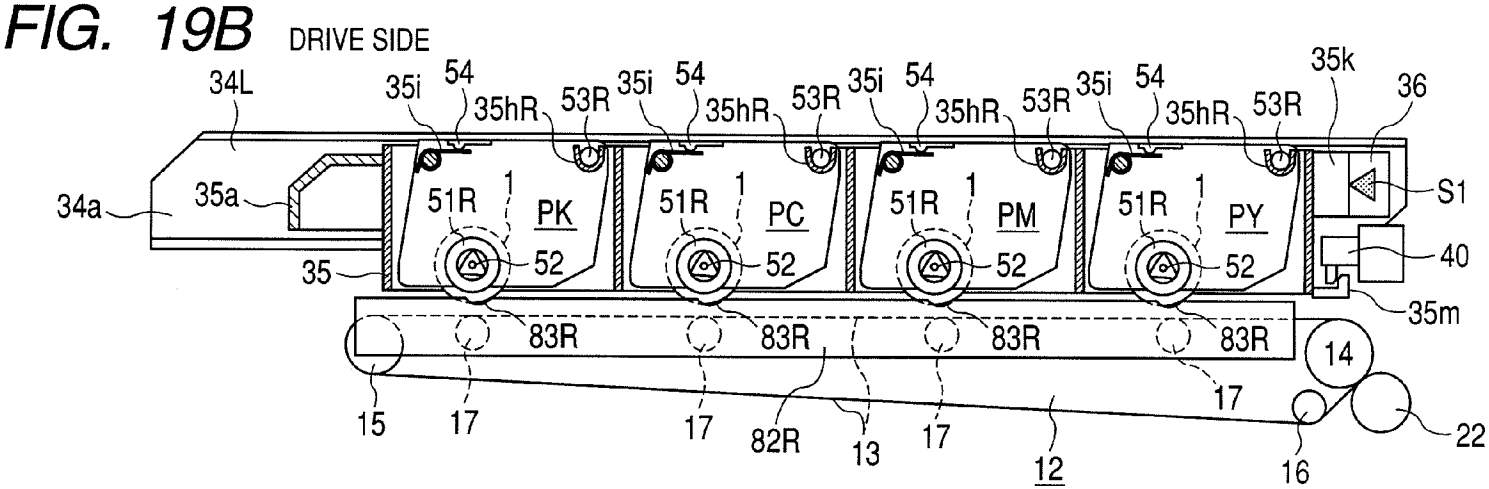
FIG. 19B DRIVE SIDE

ELECTROPHOTOGRAPHIC IMAGE FORMING APPARATUS AND PROCESS CARTRIDGE

BACKGROUND OF THE INVENTION

1. Field of the Invention

The present invention relates to an electrophotographic image forming apparatus and a process cartridge.

Here, an electrophotographic image forming apparatus forms an image on a recording medium in an electrophotographic image forming method. Examples of the electrophotographic image forming apparatus include an electrophotographic copying machine, an electrophotographic printer (for example, a laser beam printer, an LED printer and the like), a facsimile machine and a word processor.

In addition, a process cartridge (hereinafter, referred to as a cartridge) is a cartridge into which an electrophotographic photosensitive member and a process member acting on the electrophotographic photosensitive member are integrally incorporated, and which is detachably mountable to an apparatus main body of the electrophotographic image forming apparatus. Here, the cartridge may be a cartridge into which an electrophotographic photosensitive member and at least one process member such as charging means, developing means, and cleaning means are integrally incorporated. The apparatus main body is a part of an electrophotographic image forming apparatus from which the cartridge is removed.

The cartridge can be mounted and detached from the apparatus main body by a user in person. Therefore, the maintenance of the apparatus main body can be done easily.

2. Description of the Related Art

Conventionally, the construction of positioning a cartridge in an apparatus main body has been known. For example, a compression spring is disposed along a guide surface in the apparatus main body. This compression spring exerts a compression force on a dowel provided on the cartridge, about a fulcrum. When the cartridge receives a turning force from the apparatus main body, the turn of the cartridge is regulated by this construction (Japanese Patent Application Laid-Open No. 2000-132069). Owing to this construction, at the time of forming an image, the cartridge can be positioned in the apparatus main body with high accuracy.

Furthermore, an image forming apparatus in which a plurality of cartridges are arranged in line, (called an in-line type) is known. In this image forming apparatus, there are provided cartridges each including an electrophotographic photosensitive member and developing means for an associated color of yellow, magenta, cyan and black; and images of respective colors are superimposed to form a full-color image. Some image forming apparatuses are adapted to support a plurality of cartridges by a moving member that can move with respect to the apparatus main body (US 2006/0067734). Owing to this construction, by inserting the moving member into the apparatus main body, the plurality of cartridges can be inserted into the apparatus main body concurrently.

SUMMARY OF THE INVENTION

The present invention is the one that develops the above-described conventional constructions further.

The present invention provides a process cartridge, which can be positioned in an apparatus main body with high accuracy in a simple construction and an electrophotographic image forming apparatus to which the process cartridge is detachably mountable.

The present invention provides a process cartridge in which a mounting/dismounting operability of the process cartridge with respect to the apparatus main body is improved and an electrophotographic image forming apparatus to which the process cartridge is detachably mountable.

The present invention provides a process cartridge in which, in addition to the improvement of mounting/dismounting operability of the process cartridge with respect to the apparatus main body, the process cartridge can be positioned with high accuracy in the apparatus main body and an electrophotographic image forming apparatus to which the process cartridge is detachably mountable.

According to a typical construction of an electrophotographic image forming apparatus of the present invention, an electrophotographic image forming apparatus in which a process cartridge that includes an electrophotographic photosensitive drum and a process member acting on the electrophotographic photosensitive drum is detachably mounted in an apparatus main body of the electrophotographic image forming apparatus for forming an image on a recording medium, the electrophotographic image forming apparatus comprises: a moving member, which supports the process cartridge and assumes a pullout position in which the moving member is pulled out outside of the apparatus main body and the process cartridge is detachably mountable to the moving member, and an inside position for mounting the process cartridge inside the apparatus main body; and a moving device, which moves the process cartridge between a first position for retracting the process cartridge from a latent image forming position and a second position for positioning the process cartridge in the latent image forming position in a state in which the moving member is positioned in the inside position.

Furthermore, according to a typical construction of a process cartridge of the present invention, a process cartridge, is detachable mountable to an electrophotographic image forming apparatus for forming an image on a recording medium, the electrophotographic image forming apparatus including: a moving member, which supports the process cartridge and assumes a pullout position in which the moving member is pulled out outside of an apparatus main body and the process cartridge is detachably mountable to the moving member, and an inside position for mounting the process cartridge inside the apparatus main body; and a moving device, which moves the process cartridge between a first position for retracting the process cartridge from a latent image forming position and a second position for positioning the process cartridge in the latent image forming position in a state in which the moving member is positioned in the inside position, the process cartridge being detachably mountable to the moving member of the electrophotographic image forming apparatus, the process cartridge comprising: an electrophotographic photosensitive drum; a process member acting on the electrophotographic photosensitive drum; and a supported portion to be supported by a moving member side supporting portion such that the process cartridge assumes a first position for retracting the process cartridge from a latent image forming position and a second position for positioning the process cartridge in the latent image forming position in a state in which the moving member is positioned in the inside position.

Further features of the present invention will become apparent from the following description of exemplary embodiments with reference to the attached drawings.

BRIEF DESCRIPTION OF THE DRAWINGS

FIGS. 19A and 19B are views illustrating the state in which the tray is in an inside position, and the cartridge that is supported by the tray is in a positioning releasing position.

DESCRIPTION OF THE EMBODIMENTS

Embodiment (Overall Schematic Construction of an Image Forming Apparatus)

Figure 1:
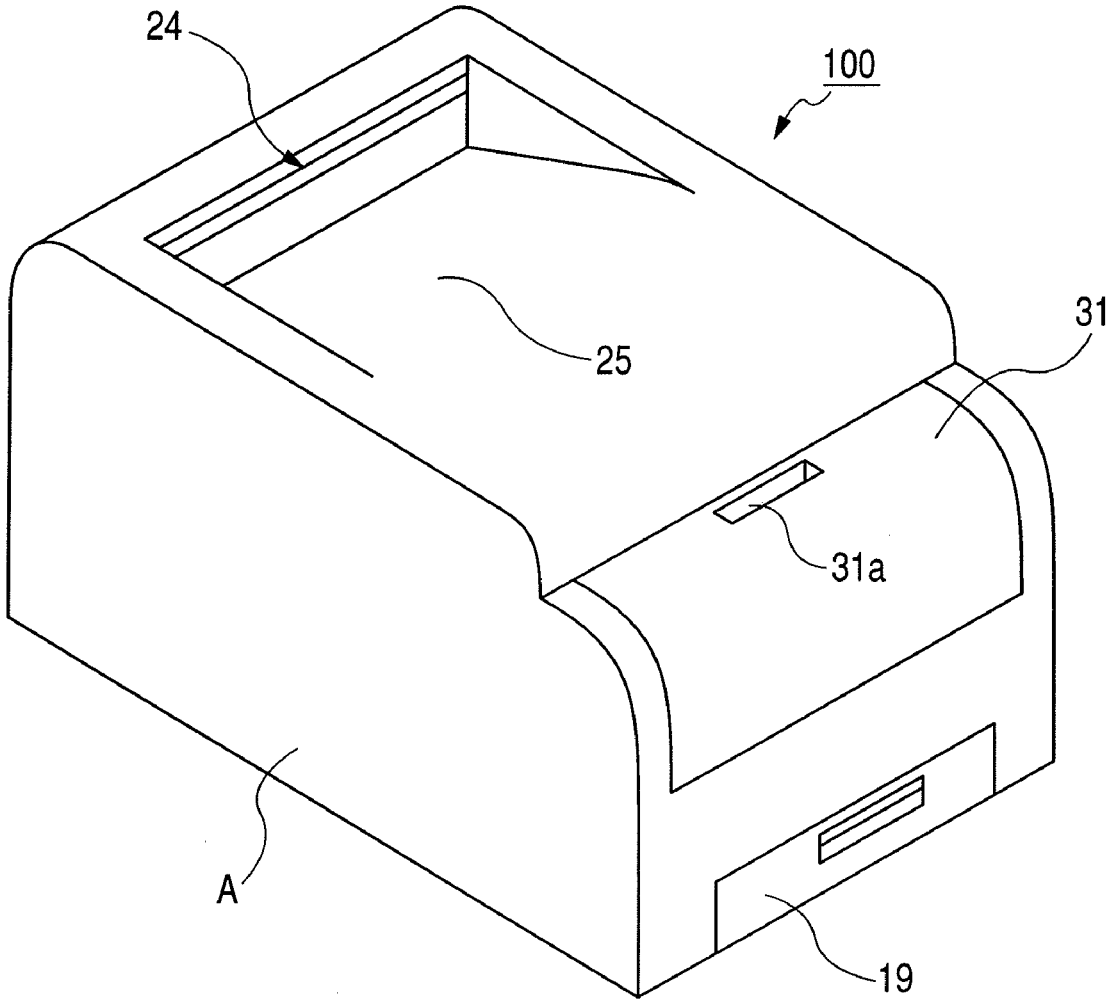
FIG. 1 is a pictorial perspective view of an image forming apparatus according to an exemplary embodiment.
Figure 2:
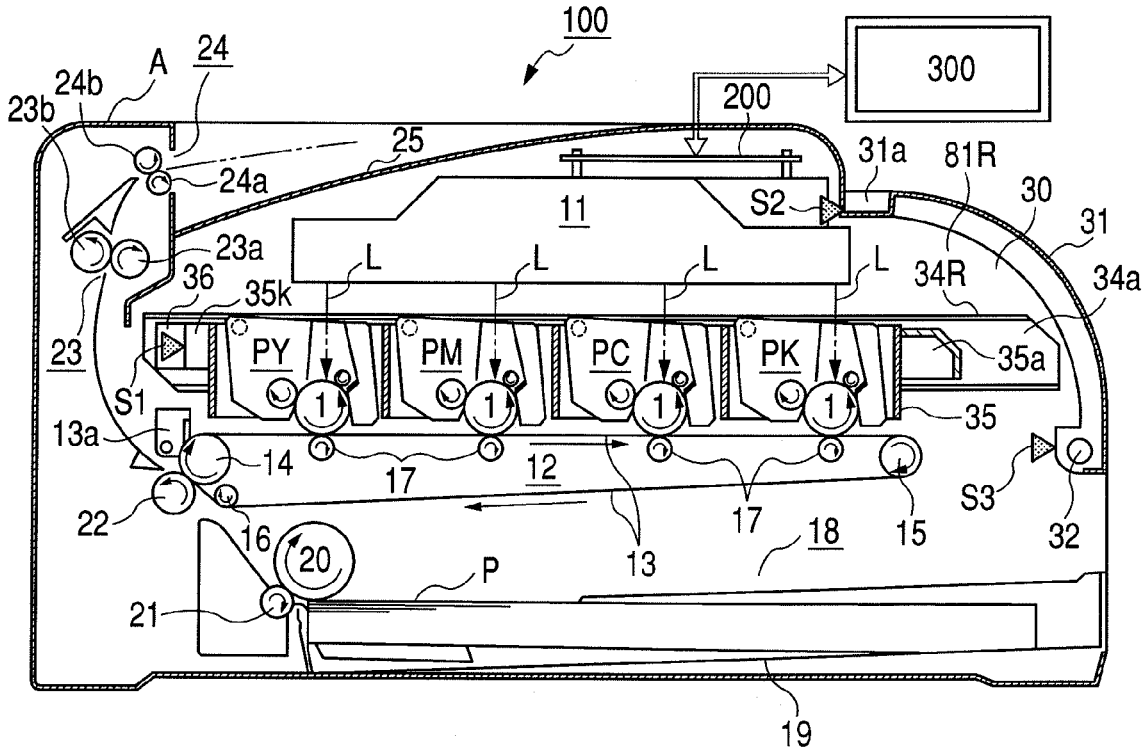
FIG. 2 is a vertical sectional left side view of this image forming apparatus.
Figure 3:
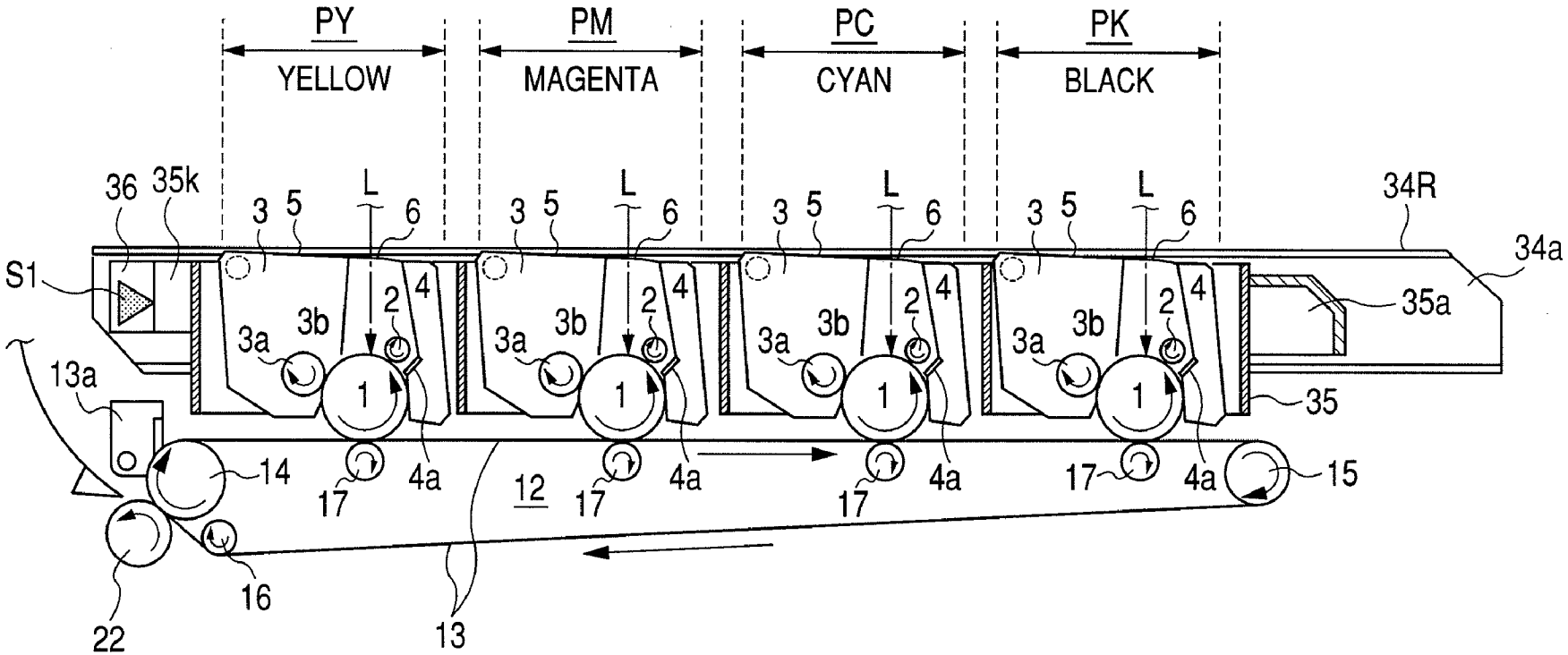
FIG. 3 is a partially enlarged view of FIG. 2.

FIG. 1 is a pictorial perspective view of an electrophotographic image forming apparatus 100 of this exemplary embodiment. FIG. 2 is a vertical sectional left side view of this image forming apparatus. FIG. 3 is a partially enlarged view of FIG. 2. This image forming apparatus is a full-color laser printer of four colors employing en electrophotographic process. Further, this image forming apparatus performs an image formation with respect to a recording medium (for example, a sheet, an OHP sheet, and a label) P on the basis of an electrical image signal that is input from an external host device 300 such as a personal computer, an image reader, and a facsimile at the other end, to a control circuit portion 200.

In descriptions hereinafter, as to this image forming apparatus 100, an anterior side (front side) is the side where a door member 31 is located. A rear side is the opposite side thereto. A front-back direction is the direction of facing from the rear side toward the anterior side of the image forming apparatus (forward), and the direction opposite thereto (backward). Left and right are the left side or the right side as viewed from the front side of the image forming apparatus. A lateral direction is the direction facing from the right toward the left of the image forming apparatus (leftward), and the direction opposite thereto (rightward). An apparatus main body A is an image forming apparatus portion other than a process cartridge.

In an internal part of the apparatus main body A, from the rear side to the front side, there are disposed four process cartridges of a first, second, third, and fourth process cartridges (hereinafter, referred to as cartridges) PY, PM, PC, and PK in line in a horizontal direction (longitudinal direction) (in-line construction, tandem-type). Each cartridge is detachably mounted to the apparatus main body A, which will be described later.

Respective cartridges contain developers (toners) of different colors, and mutually have the same construction. In each cartridge according to this embodiment, an electrophotographic photosensitive drum (hereinafter, referred to as a drum) 1, and charging means 2, developing means 3, and cleaning means 4, witch are process members acting on the photosensitive drum 1 are integrally incorporated into a cartridge frame 5. The charging means 2 is means for uniformly charging the surface of the drum 1 at a predetermined polarity and potential. A charging roller is used as the charging means 2. The developing means 3 is means for visualizing an electrostatic latent image having been formed on the surface of the drum 1. A developing roller 3*a* is as the developing means. Furthermore, a developer (toner) is contained in a developer container 3*b*. The cleaning means 4 is means for cleaning the surface of the drum 1 after a developer image has been transferred. A cleaning blade 4*a* is used as the cleaning means.

The first cartridge PY contains a developer of yellow color (Y color) in the developer container 3*b*, and forms the developer image of Y color on the surface of the drum 1. The second cartridge PM contains a developer of magenta color (M color) in the developer container 3*b*, and forms the developer image of M color on the surface of the drum 1. The third cartridge PC contains a developer of cyan color (C color) in the developer container 3*b*, and forms the developer image of C color on the surface of the drum 1. The fourth cartridge PK contains a toner of black color (K color) in the developer container 3*b*, and forms the developer image of K color on the surface of the drum 1.

Above the cartridges PY, PM, PC, and PK, there is disposed a laser scanner unit 11 serving as image exposure means. The scanner unit 11 outputs a laser light L that is modulated based on image information of each color to be input to the control circuit portion 200 from the external host device 300, and causes this laser light L to enter the cartridge through an exposure window 6 in the upper surface of the cartridge frame 5, to scan and expose a drum surface of each cartridge.

Below the cartridges PY, PM, PC, and PK, there is disposed an intermediate transfer belt unit 12. This belt unit 12 includes an endless belt (hereinafter, referred to as a belt) 13 having flexibility, a drive roller 14, a turn roller 15, and a tension roller 16. The belt 13 is passed over the drive roller 14, the turn roller 15, and the tension roller 16 and circulated by the drive roller 14. The drive roller 14 and the tension roller 16 are disposed at the rear side in the apparatus main body A. The turn roller 15 is disposed in the front side in the apparatus main body A. The drum 1 each cartridge includes is contacted with the upper surface of the ascending side belt portion of the belt 13 at the underside thereof. On the inside of the belt 13, there are disposed four primary transfer rollers 17 each opposed to the drum 1 of each cartridge via the ascending side belt portion. A secondary transfer roller 22 abuts against the drive roller 14 through the belt 13.

Below the belt unit 12, there is disposed a feeding unit 18. This unit 18 includes a tray 19, a feed roller 20, a separation roller (retard roller) 21 and the like. The tray 19 is free to be put in or taken out from the front side of the apparatus main body A (front loading).

At the upper portion on the rear side in the apparatus main body A, there are disposed a fixing device 23 and a pair of discharge rollers 24. The upper surface of the apparatus main body A is to be a discharge tray 25. The fixing device 23 employs the one that includes a fixing film assembly 23*a* and a pressure roller 23*b*. A pair of discharge rollers 24 includes a roller 24*a* and a rotatable member 24*b*.

Each cartridge, as described below, is held in a positioning state in which a positioned portion is pressed onto an apparatus main body side positioning portion of the apparatus main body A by the pressure operation of a pressure member to be engaged. In this state, the underside of the drum is in contact with the belt 13. In addition, a drive output portion on the apparatus main body side is connected with respect to a drive input portion of this cartridge. Moreover, a power feed system on the apparatus main body side is electrically connected with respect to an electrical contact of this cartridge.

The operation for forming a full-color image is as follows. The drum 1 of each of the first to the fourth cartridges PY, PM, PC, and PK is driven to rotate at a predetermined control speed in a counterclockwise direction indicated by an arrow. The belt 13 is also driven to rotate at the speed based on the speed of the drum 1 in a clockwise direction (in a forward direction of the drum rotation) indicated by an arrow. The scanner unit 11 is driven as well. In synchronization with this driving, in a predetermined control timing in each cartridge, the charging roller 2 uniformly charges the surface of each drum 1 at a predetermined polarity and potential. The scanner unit 11 makes scanning and exposure of the surface of each drum 1 with the laser light L having been modulated based on image signals of each color. Whereby, an electrostatic latent image based on the image information of a corresponding color is formed on the surface of each drum 1. The electrostatic latent image having been formed is developed as a developer image by the developing roller 3*a*.

By the above-mentioned electrophotographic image forming process operation, on the drum 1 of the first cartridge PY, Y color developer image corresponding to a yellow component of a full-color image is formed, and this developer image is primarily transferred onto the belt 13. On the drum 1 of the second cartridge PM, a developer image of M color corresponding to a magenta component of the full-color image is formed, and this developer image is primarily transferred and superimposed on the developer image of Y color having been transferred on the belt 13 already. On the drum 1 of the third cartridge PC, a developer image of C color corresponding to a cyan component of the full-color image is formed, and this developer image is primarily transferred and superimposed on the developer image of Y color+M color having been transferred on the belt 13 already. On the drum 1 of the fourth cartridge PK, a developer image of K color corresponding to a black component of the full-color image, and this developer image is primarily transferred and superimposed on the developer image of Y color+M color+C color having been transferred on the belt 13 already. With the arrangement, the developer image not having been fixed yet of a full color of four colors of Y color+M color+C color+K color is synthesized and formed on the belt 13.

In each cartridge, the remaining developer not having been transferred on the surface of the drum 1 after the primary transfer of the developer image to the belt 13 is removed by the cleaning means 4.

Whereas, the feed roller 20 is driven in a predetermined control timing. Whereby, by the cooperation between the roller 20 and the separation roller 21, one recording sheet P as a recording medium stacked on the tray 19 is separated and fed. Then, the sheet P is introduced to a nip portion (secondary transfer nip portion) between the secondary transfer roller 22 and the belt 13. Whereby, in the process in which the sheet P is sandwiched and conveyed through the nip portion, the developer image of four superimposed colors on the belts 13 is sequentially transferred all together onto the surface of the sheet P.

The sheet P is separated from the surface of the belt 13 to be introduced to the fixing device 23, and heated and pressed in a fixing nip portion. Whereby, color mixing of respective colors of the developer image and fixing onto the sheet are conducted. Further, the sheet P is fed out of the fixing device 23, and discharged onto the tray 25 by a pair of the discharge rollers 24 as a full-color image formation article.

The remaining developer not having been secondarily transferred on the surface of the belt 13 from which the sheet has been separated is removed by belt cleaning means 13*a*.

(Cartridge Replacement System)

In each of the first to the fourth cartridges PY, PM, PC, and PK, each developer (toner) that is contained in the developing means 3 is consumed as it is used for image formation.

Then, for example, there is provided the means (not illustrated) for detecting the remaining amount of a developer of respective cartridges, in the control circuit portion 200, the remaining detected value is compared with a threshold for cartridge life preliminary notice or for product life caution having preliminarily been set. As to the cartridge the remaining detected value of which comes to be the remaining value less than the threshold, the product life preliminary notice or the product life caution of this cartridge is indicated in an indicating portion (not illustrated). Whereby, a user is urged to prepare a cartridge for replacement or urged to replace the cartridge, to keep the quality of an output image.

Figure 6:
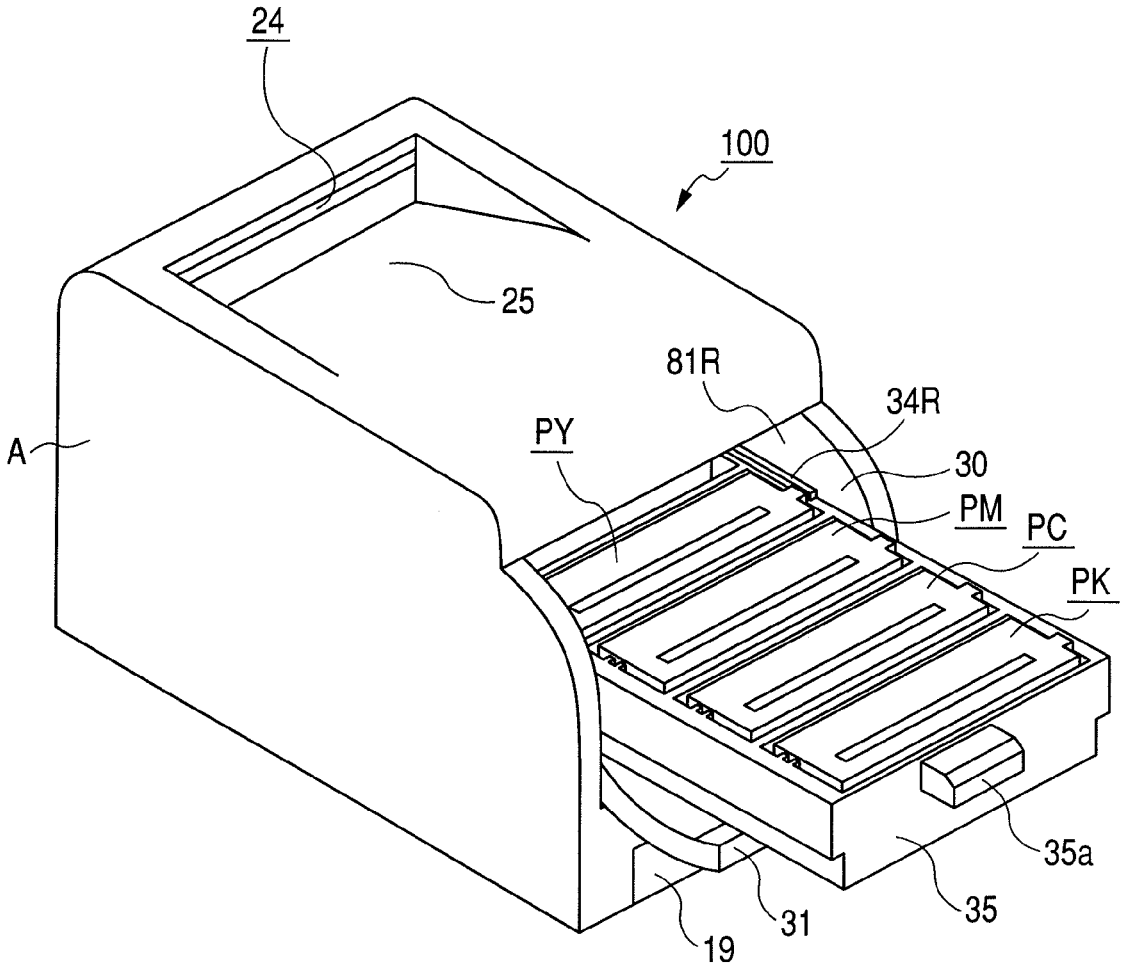
FIG. 6 is a pictorial perspective view of the image forming apparatus in the state in which a tray is pulled out.
Figure 7:
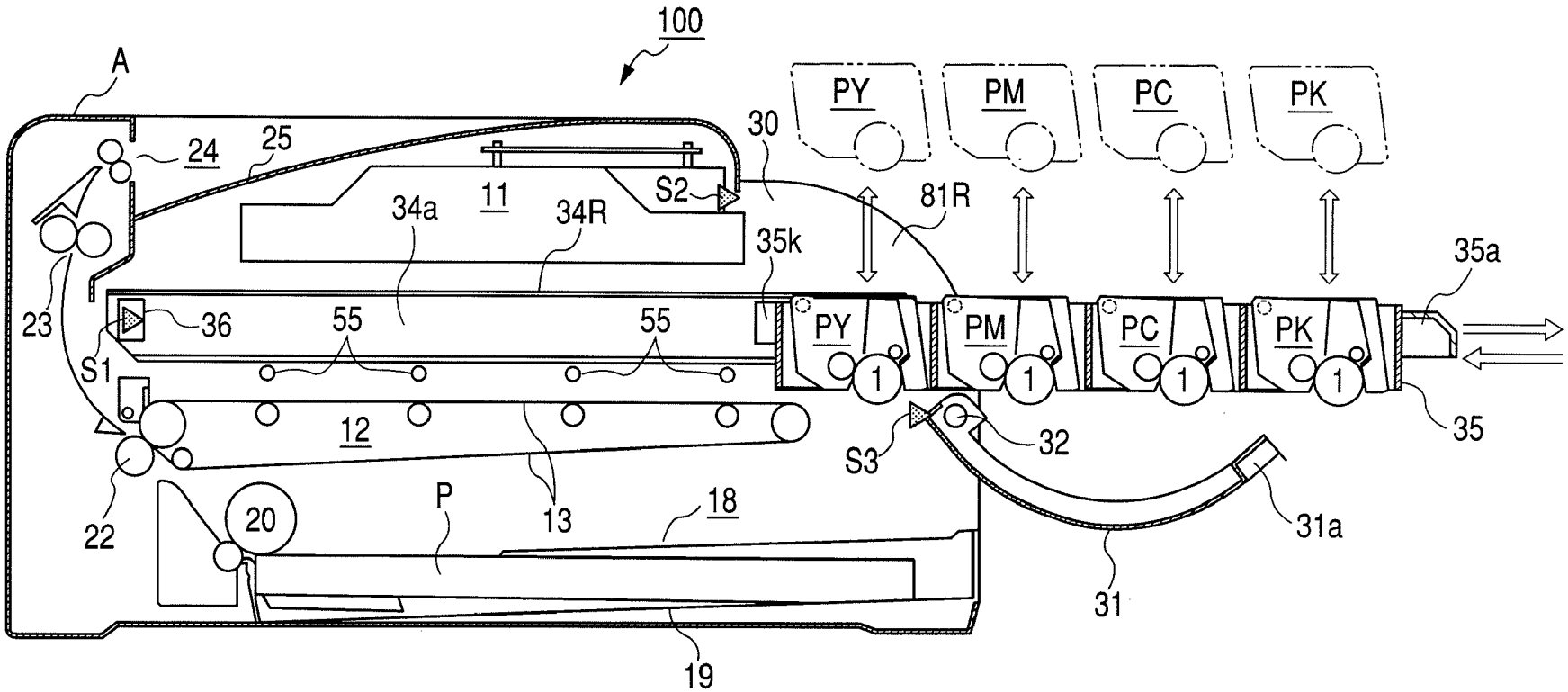
FIG. 7 is a vertical sectional left side view of the image forming apparatus in the state in which the tray is pulled out.

In the image forming apparatus 100 according to this embodiment, the replacement of a cartridge is conducted in the following system to improve usability. The cartridges PY, PM, PC, and PK are mounted on a cartridge tray (hereinafter, referred to as a tray) 35, being a moving member. Furthermore, by front access, the tray 35 is pulled out of the apparatus main body A in a horizontal direction to replace the cartridge. When the tray 35 is pulled out to the outermost side of the apparatus main body A, as illustrated in FIGS. 6 and 7, all the cartridges PY, PM, PC, and PK are outside of the apparatus main body A. Therefore, the replacement operation of the cartridge with respect to the tray 35 can be performed easily.

Then, on the front side of the image forming apparatus 100, there is provided an opening 30 causing the cartridge to pass through in order that the cartridge is inserted into the inside of the apparatus main body A, and that the cartridge is taken out from the inside of the apparatus main body A. In addition, there is provided a door member (opening/closing member: hereinafter, referred to as a door) 31 that can be opened or closed between a closing position in which this opening 30 is closed and an opening position in which the opening 30 is opened. That is, in an operation of the image forming apparatus, the door 31 is closed to the position of closing the opening 30 through which the cartridge is allowed to pass. When the cartridge is taken out, the door 31 is opened to the position of opening the opening 30.

Figure 4A:
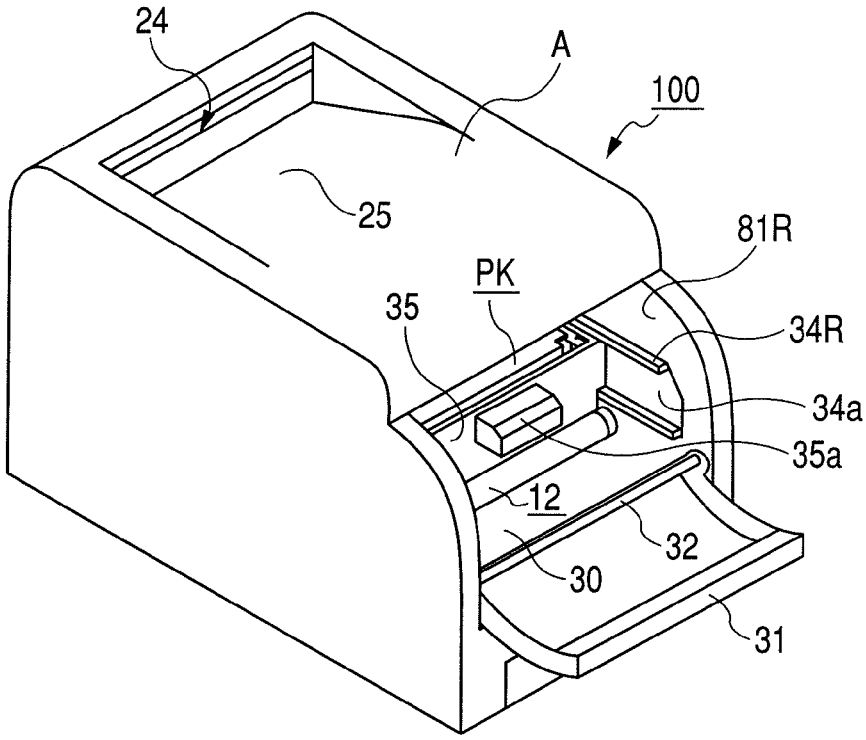
FIGS. 4A and 4B are pictorial perspective views of the image forming apparatus in the state in which a door is opened.
Figure 4B:
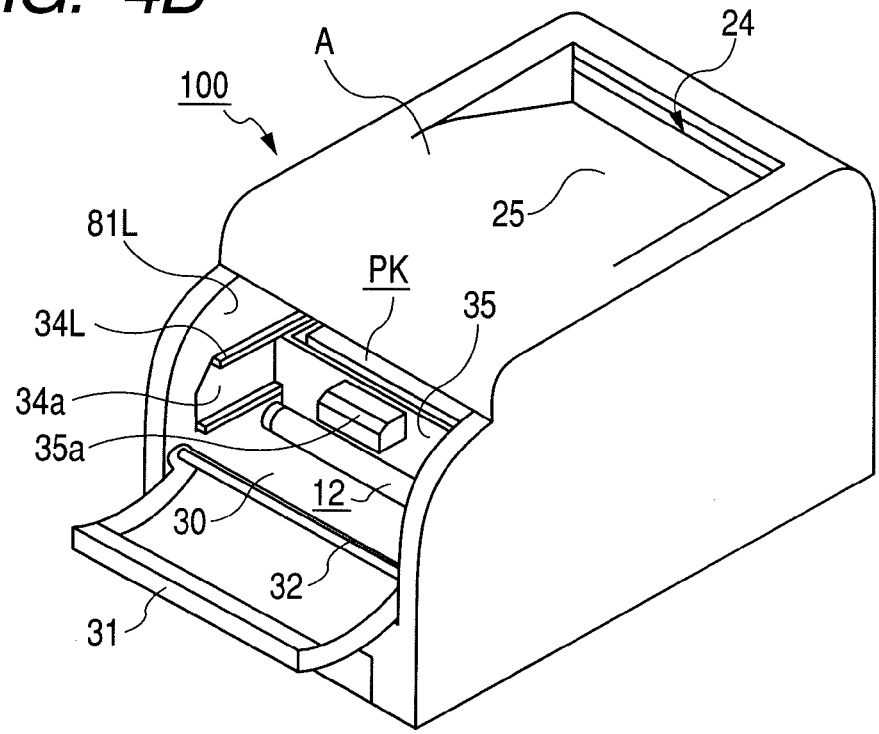
Figure 5:
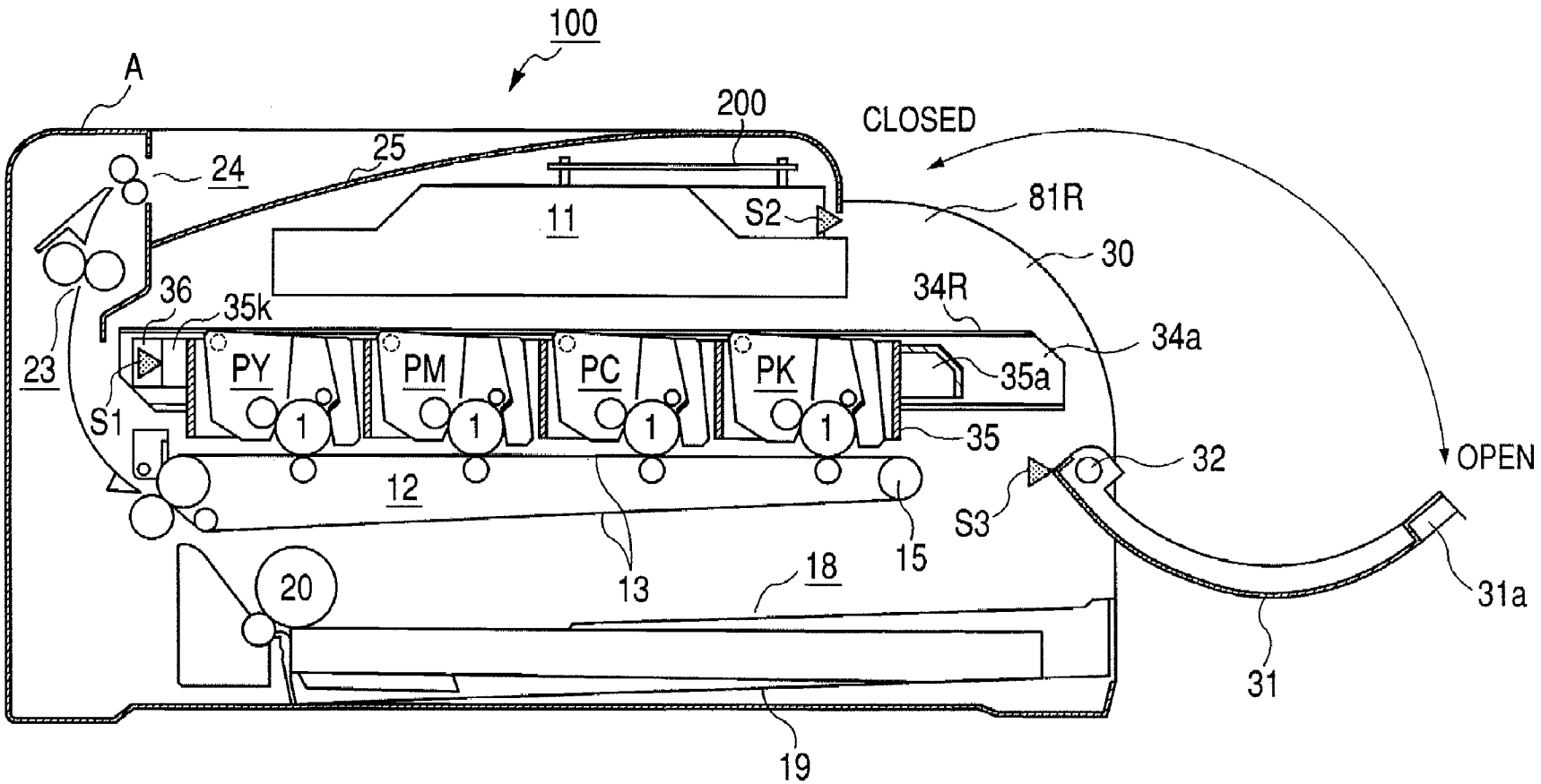
FIG. 5 is a vertical sectional left side view of the image forming apparatus in the state in which the door is opened.

In this embodiment, this door 31 can be pivotally opened and closed with respect to the apparatus main body A about a lateral shaft (hinge shaft) 32 in the lateral direction on the bottom side of the door. Further, the door 31 is turned in a standing direction about the hinge shaft 32, and as illustrated in FIGS. 1 and 2, can be in the state of being closed with respect to the apparatus main body A. Closing this door 31 closes the opening 30. Moreover, the door 31 is turned down to the front side of the apparatus main body A about the hinge shaft 32, and as illustrated in FIGS. 4A, 4B and 5, can be in the state of being opened from the apparatus main body A. Whereby, the opening 30 in the front of the apparatus main body A is largely open. FIG. 4A is a pictorial perspective view of the image forming apparatus in the state in which the door 31 is open, as viewed from the left side. FIG. 4B is a pictorial perspective view as viewed from the right side. A gripping portion 31*a* is provided in the door 31.

Furthermore, on the inside of a left frame (left side plate) 81L of a main frame, being a frame of the apparatus main body A and on the inside of a right frame (right side plate) 81R thereof, there is disposed a pair of left and right rail members (tray holding members) 34L and 34R of which a longitudinal direction is the front-back direction. Between these left and right rail members 34L and 34R, the tray 35, being the moving member is held so as to be capable of slidingly moving horizontally in the front-back direction. The cartridges PY, PM, PC, and PK are supported by this tray 35 such that the axial direction of the drum 1 of the cartridge intersects the moving direction of the tray 35. Moreover, the tray 35 is moved along the rail members 34L and 34R, and passed through the opening 30 that is opened, to assume a pullout position (FIGS. 6 and 7) in which the cartridge is detachably mountable to the tray 35 outside of the apparatus main body A. In addition, the tray 35 is moved along the rail members 34L and 34R, to assume an inside position (FIGS. 2, 3 and 5) for mounting the cartridge inside the apparatus main body.

As illustrated in FIG. 2, in the state in which the tray 35 that holds the cartridges is moved in the inside position, and the door 31 is closed, the tray 35 is regulated (locked) in the inside position by the below-described movement regulating member. That is, the tray 35 is engaged so as not to move from this inside position.

Furthermore, the cartridge that is held by the tray 35 has been converted from a first position (retracted position) for retracting the cartridge from a latent image forming position into a second position for positioning the cartridge in the latent image forming position, by a position converting member (which will be described below).

In the state in which the cartridge has been converted into the second position, a positioned portion on the cartridge side abuts against an apparatus main body side positioning portion to be positioned in position, and the drum underside of the cartridge is in contact with the belt 13.

As described above, the latent image forming position (the second position) is the position in which the cartridges PY, PM, PC, and PK are supported by the apparatus main body A. In this latent image forming position, an electrostatic latent image based on an image signal of a corresponding color is formed on the surface of the drum 1 of each cartridge by the above-described image forming process.

When the cartridge is replaced, the door 31 is opened and turned. In this embodiment, in conjunction with this door 31 being turned to be opened, the connection of the drive output portion on the apparatus main body side with respect to the drive input portion of the cartridge is released (drive release). In addition, in conjunction with the door 31 being turned to open further, the pressure member that positions and secures each cartridge in the positioning position (the second position) performs a pressure releasing operation (pressure release). By this pressure release, in the state in which the cartridge is supported by the tray 35, the cartridge is moved to a positioning releasing position (the first position) in which the positioned portion (right bearing portion 51R and left bearing portion 51L as described later) is separated from the apparatus main body side positioning portion (recesses 83R and 83L as described later). With the arrangement, the cartridge assumes from the state of FIG. 2 in which the drum underside is contacted with the belt 13 to the state of FIG. 5 in which the drum underside is separated from the belt 13. Moreover, by the movement of the cartridge to the positioning releasing position, the electrical connection between the electrical contact of the cartridge and the power feed system on the apparatus main body side is shut off (power feed release). Then, after the pressure member performed a pressure releasing operation, until the door 31 comes to be in a state of being fully opened, the movement regulating member performs a regulation releasing operation, and thus the regulation of the tray 35 is released (tray regulation release).

Then, a user grips the gripping portion 35*a* that is exposed from the opening 30, and causes the tray 35 to slidingly move in the horizontal direction frontward with respect to the rail members 34L and 34R. Further, the tray 35, as illustrated in FIGS. 6 and 7, is passed through the opening 30 and pulled out fully to a predetermined pullout position where the cartridge is detachably mountable at the outside of the apparatus main body A. Here, the cartridge is held by the tray 35 in the state in which the drum underside is separated from the belt 13. Then, in the pullout movement process of the tray 35, there is no friction between the drum 1 and the belt 13. Therefore, the scratch or the memory caused by the friction between the drum 1 and the belt 13 can be prevented.

By this pullout operation of the tray 35, all of the cartridges PY, PM, PC, and PK that are held by the tray 35 are passed through the opening 30 to be exposed to the outside of the apparatus main body A, and the top of all the cartridges are opened. When the tray 35 is pulled out a predetermined sufficient amount, the tray 35 is prevented from being pulled out and moved further by a stopper portion (not illustrated). Moreover, the tray 35 is held with stability in the state of being horizontally pulled out to a predetermined pullout position by the rail members 34L and 34R.

The tray 35, in the pullout position, supports individual cartridges so as to be capable of being taken out right above, and supports individual cartridges so as to be capable of being moved right below. Then, a user, as indicated by a two-dot chain line of FIG. 7, lifts up and takes out of the tray 35 the spent cartridge that has to be replaced. Then, a new cartridge is fit into the tray 35 from above and put on the tray 35.

In the above-mentioned descriptions, the tray 35 is a moving member provided so as to be capable of moving in the direction intersecting the axial direction (longitudinal direction) of the drum 1 the cartridge includes, as well as being capable of moving between the inside and the outside of the apparatus main body A. Furthermore, this tray 35 is a moving member which can assume a pullout position where the cartridge is detachably mountable on the tray 35 pulled out passing through the opening 30, at the outside of the apparatus main body A, and an inside position for mounting the cartridge inside the apparatus main body A. Moreover, the left and right rail members 34L and 34R are supporting structures supporting the tray 35 to move the tray 35 between the pullout position and the inside position.

In this embodiment, the tray 35 supports the cartridges PK, PC, PM, and PY containing the developers of K color, C color, M color and Y color, respectively, arranged in order of mention from the upstream side to the downstream side in the moving direction of moving from the outside to the inside of the apparatus main body A. With the arrangement in this embodiment, the cartridge PK of K color which developer is much likely to be consumed, that is, which replacement frequency is high is located on the most front side. Therefore, when the tray 35 is pulled a little to the outside, the cartridge PK can be exposed to the outside of the apparatus main body A. Thus, replacement operability of the cartridge PK can be improved.

(Cartridge)

Figure 8:
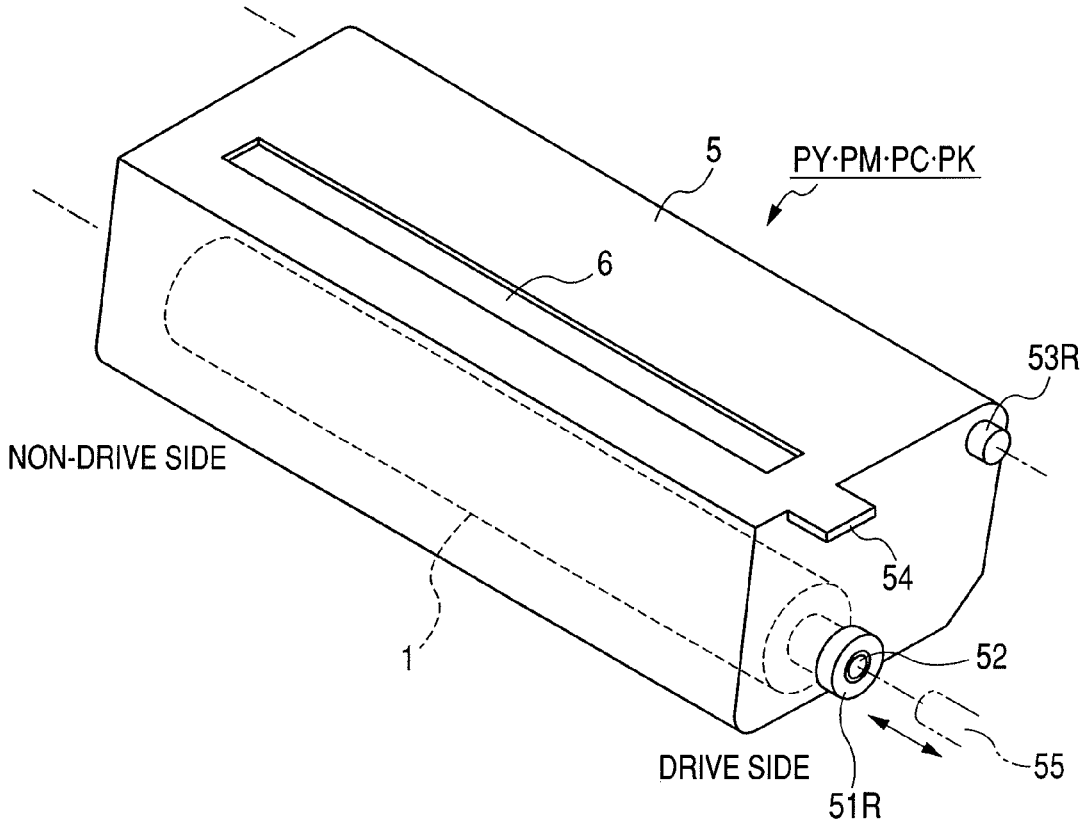
FIG. 8 is a perspective view of a cartridge as viewed from a drive side.
Figure 9:
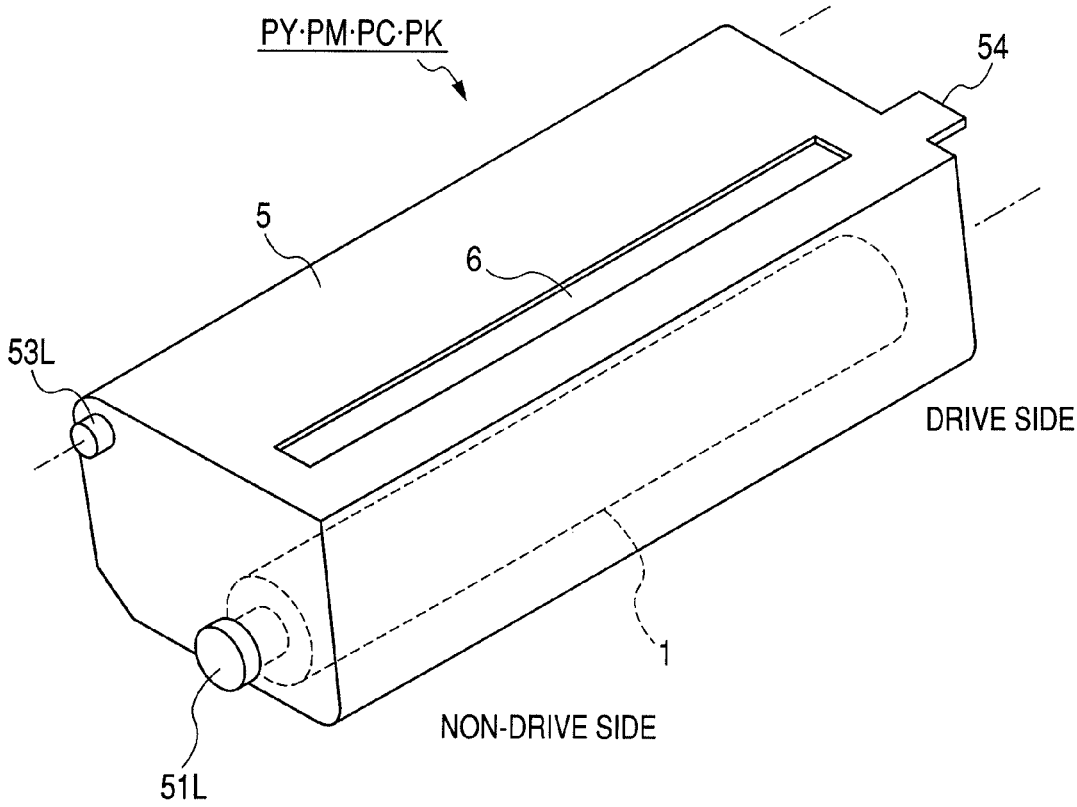
FIG. 9 is a perspective view of the cartridge as viewed from a non-drive side.
Figure 10:
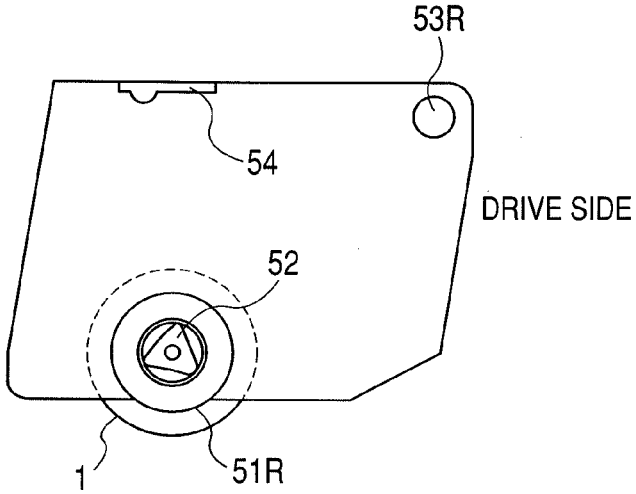
FIG. 10 is a right side view (drive side) of the cartridge.
Figure 11:
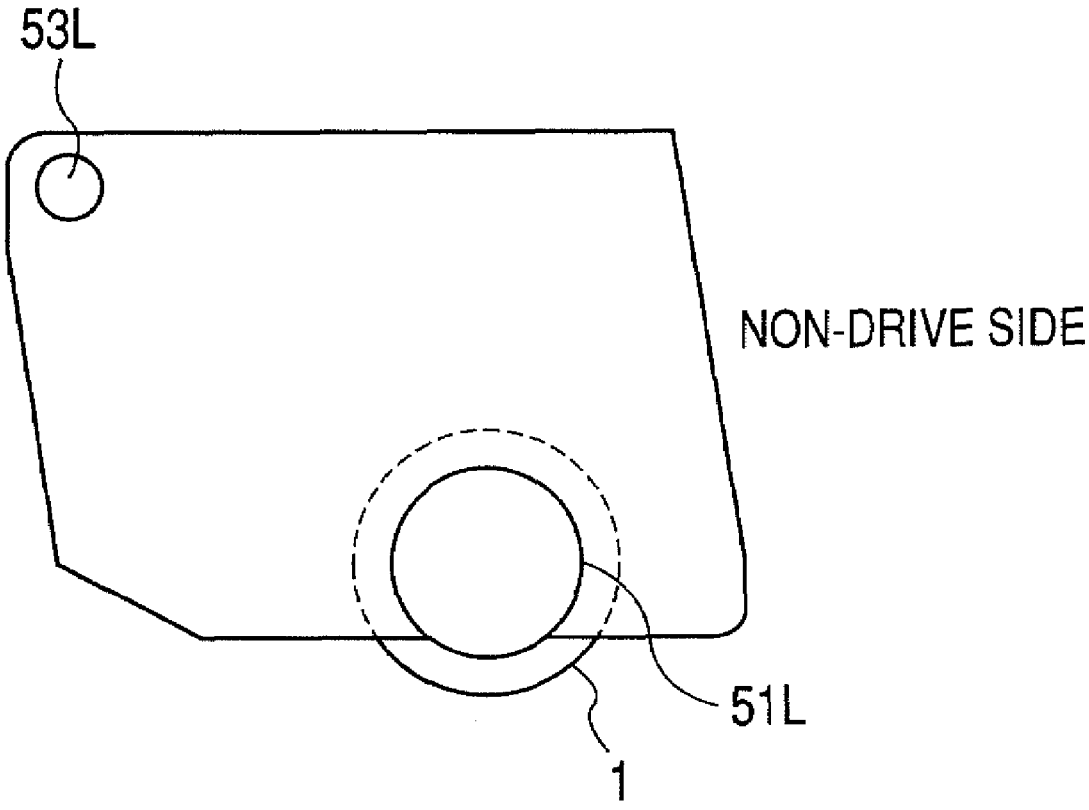
FIG. 11 is a left side view (non-drive side) of the cartridge.

FIG. 8 is a pictorial perspective view of the cartridge as viewed from the right side. FIG. 9 is a pictorial perspective view as viewed from the left side. FIG. 10 is the right side view of the cartridge. FIG. 11 is the left side view.

The cartridge is an assembly of a laterally elongated box type in which the axial direction of the drum 1 extends in the lateral direction, which is a longitudinal direction of the cartridge. The drum 1 is rotatably supported between the right bearing portion 51R and the left bearing portion 51L that are disposed on the right side portion and on the left side portion of a cartridge frame 5 made of a synthetic resin respectively. A coupling fit portion 52 serving as the drive input portion is provided at the right bearing portion 51R. A drive output portion 55 on the apparatus main body side is connected to the coupling fit portion 52 to input a driving force. Whereby, the drum 1 and the developing roller 3*a* are driven. Incidentally, the right bearing portion 51R and the left bearing portion 51L are located coaxially with the drum 1. Furthermore, the right bearing portion 51R and the left bearing portion 51L are provided to protrude outward from an outer surface of the cartridge frame 5.

On the right side portion of the cartridge frame 5, there are provided a right pivot shaft 53R protruding outward from one corner portion of the upper portion of the right side portion, and a spring receiving portion 54 protruding outward form the other corner portion (above the right bearing portion 51R). Moreover, on the left side portion of the cartridge frame 5, there is provided a left pivot shaft 53L protruding outward from one corner portion of the left side portion. The axis of the right pivot shaft 53R and the axis of the left pivot shaft 53L are substantially aligned with each other, and are in parallel with the axis of the drum 1.

In the above-mentioned cartridge, the right side portion provided with the coupling fit portion 52 is the drive side, and the left side portion opposite to the right side portion is the non-drive side.

Furthermore, the right pivot shaft 53R, the left pivot shaft 53L and the spring receiving portion 54 constitute a supported member (a supported portion) to be supported by a moving member side supporting member (a supporting member).

In addition, the right bearing portion 51R and the left bearing portion 51L constitute a positioned portion to be contacted or separated with respect to the later-described apparatus main body side positioning portion.

(Tray)

Figure 12:
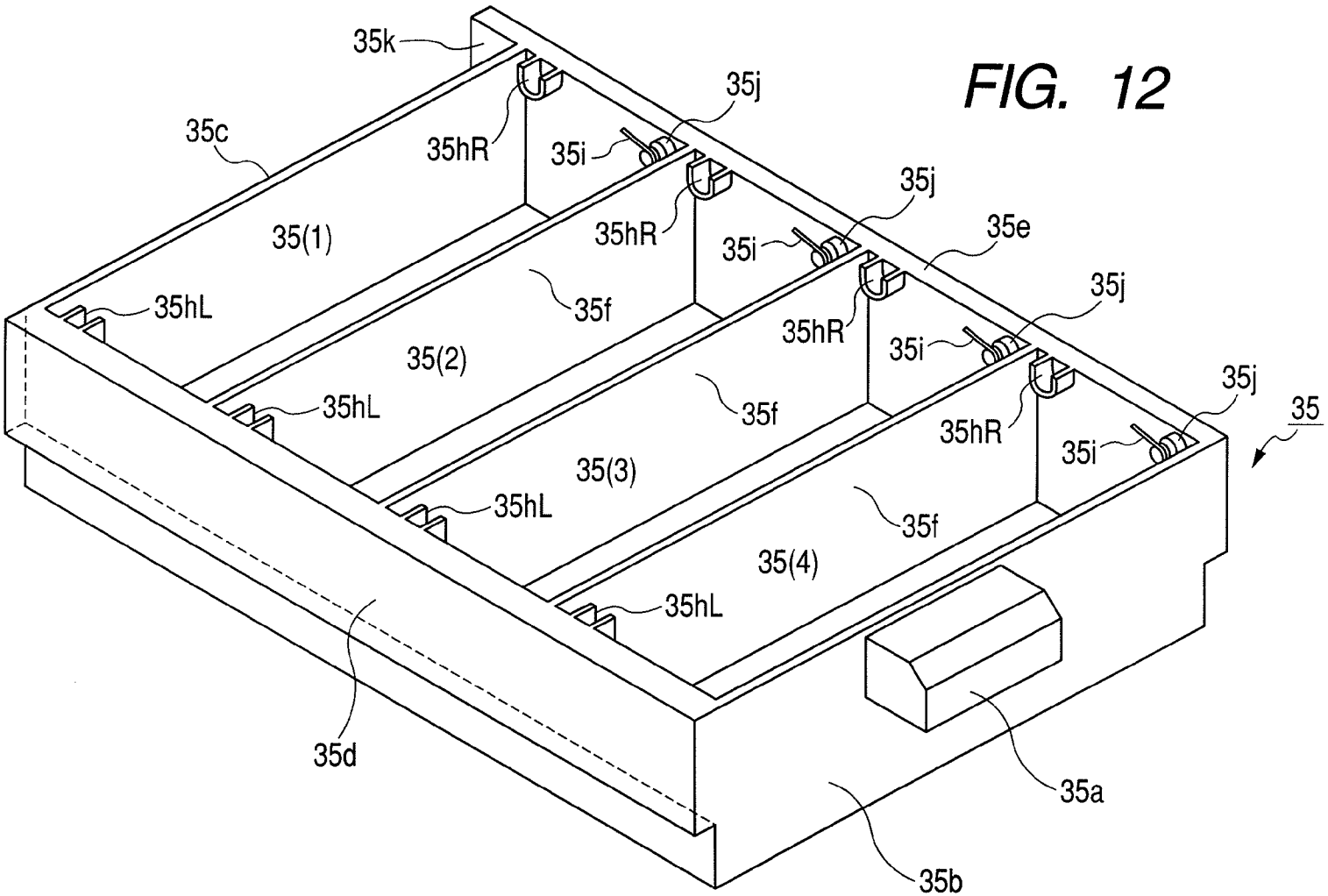
FIG. 12 is a perspective view of the tray as viewed from the non-drive side.
Figure 13:
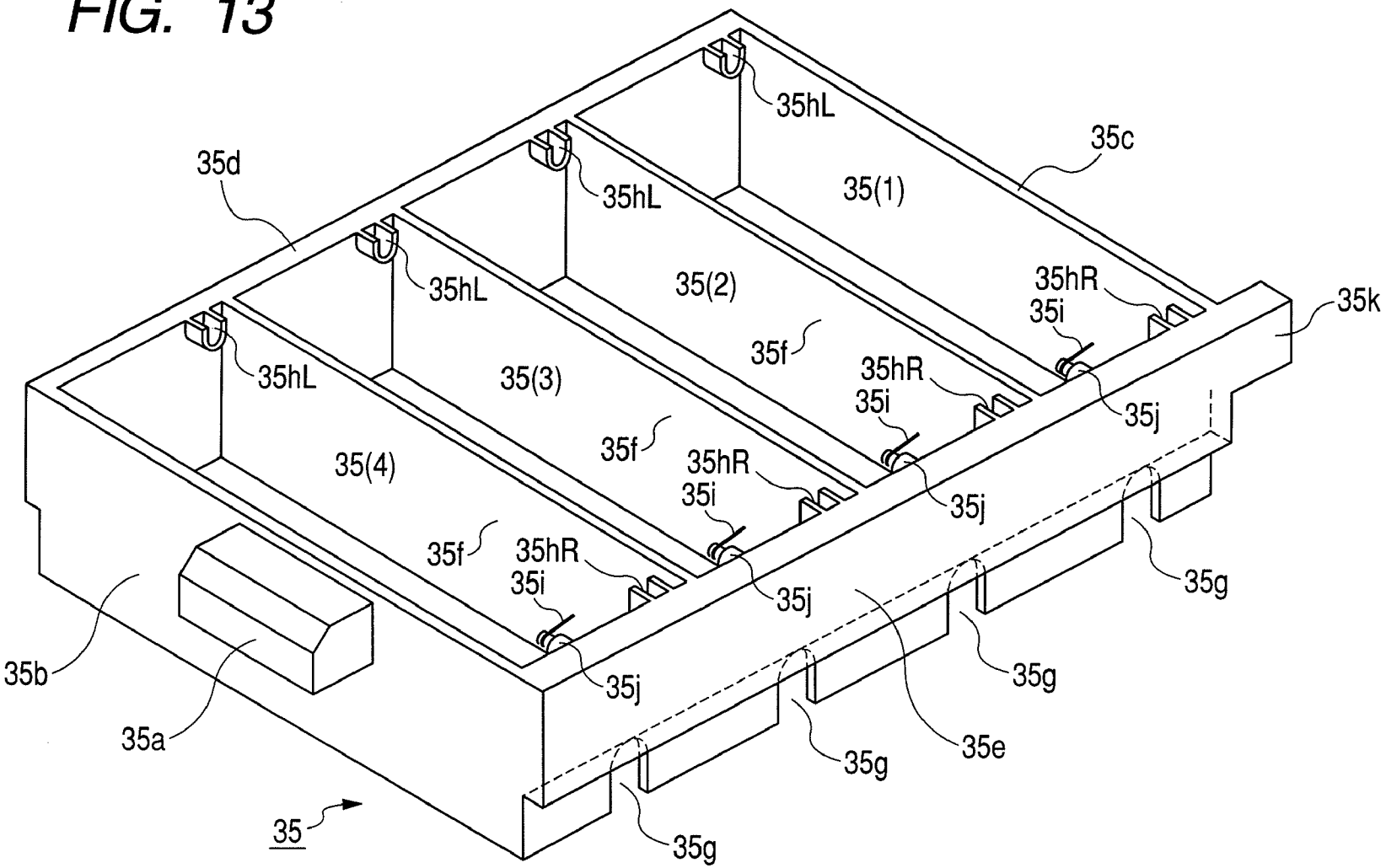
FIG. 13 is a perspective view of the tray as viewed from the drive side.
Figure 14:
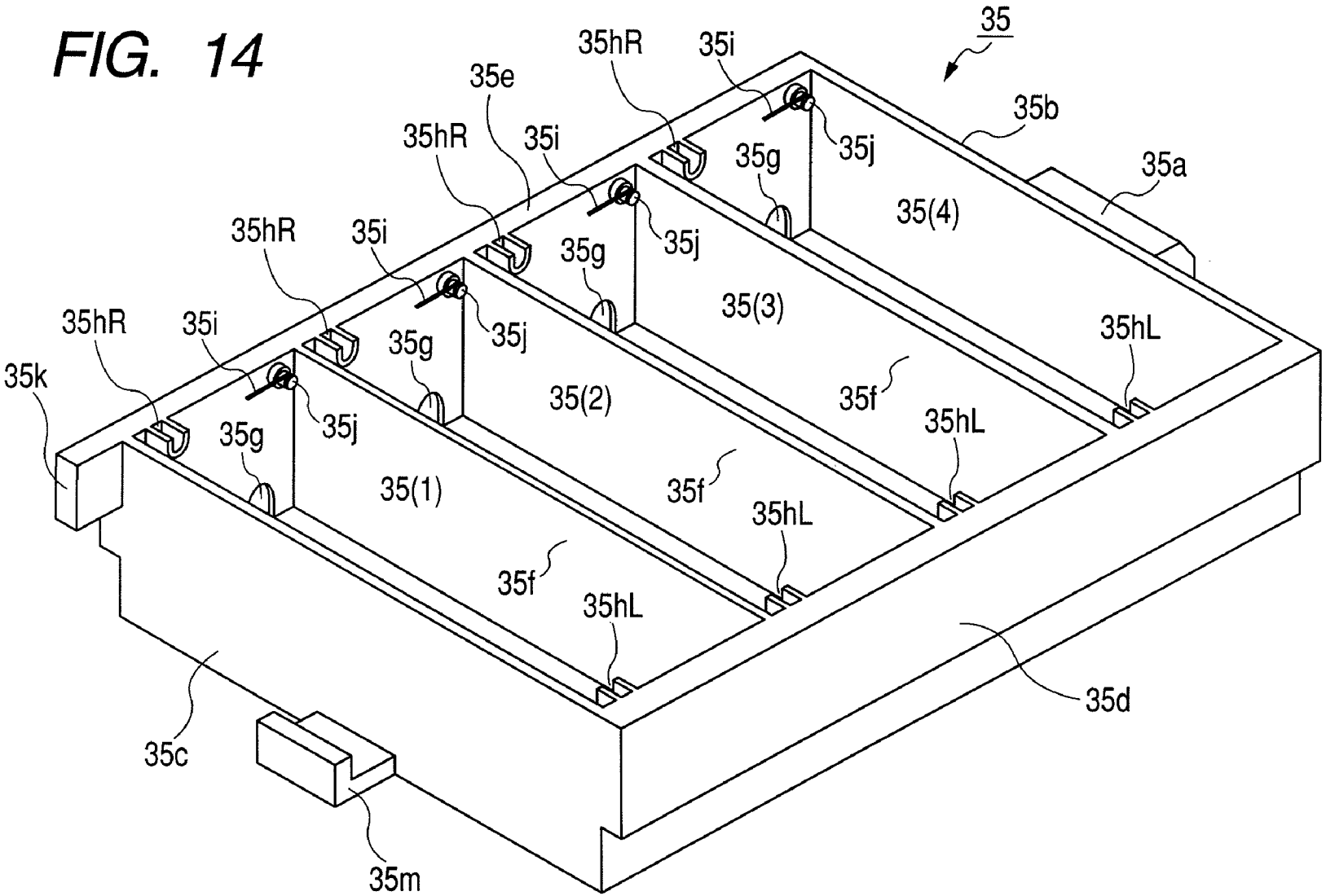
FIG. 14 is a perspective view of the tray as viewed from the back side.

FIG. 12 is a pictorial perspective view of the tray 35 as viewed from the left side (non-drive side). FIG. 13 is a pictorial perspective view as viewed from the right side (drive side). FIG. 14 is a pictorial perspective view as viewed from the backside.

This tray 35 is made of a synthetic resin, and is constructed of a rectangular large frame by four frame plates (front, back, left and right frame plates) 35*b*, 35*c*, 35*d*, and 35*e* being connected. Furthermore, the inside of this large frame is divided into four sections substantially equally in the front-back direction by three partition plates 35*f*, and thus there are provided four laterally elongated small frame portions, i.e., a first, a second, a third, and a fourth small frame portions 35(1), 35(2), 35(3), and 35(4) in the order from the back frame plate 35*c* to the front frame plate 35*b*. These small frame portions 35(1) to 35(4) are cartridge containing portions (chambers each for containing a cartridge) of containing the cartridges PY, PM, PC, and PK, respectively.

The portions of the left and right frame plates 35*d* and 35*e* of the tray 35 are fit and engaged to guide grooves 34*a* that are provided on the insides of the left and right rail members 34L and 34R, respectively, on the apparatus main body side. Whereby, the tray 35 is supported between the left and right rail members 34L and 34R. Furthermore, the tray 35 can be slid in the guide grooves 34*a*, and can be slidingly moved horizontally in the front-back directions with respect to the rail members 34L and 34R.

In each of the small frame portions 35(1) to 35(4), the right frame plate (on the drive side) 35*e* is provided with holes 35*g* through which the drive output portions 55 (FIGS. 7 and 8) on the apparatus main body side go in and out with respect to the tray 35.

In addition, in each of the small frame portions 35(1) to 35(4), a right bearing portion 35*h*R corresponding to the right pivot shaft 53R of the cartridge and a cartridge urging spring (spring member) 35*i* corresponding to the spring receiving portion 54 of the cartridge are provided on the inside upper portion of the right frame plate 35*e* with a spacing therebetween in the front-back direction. Moreover, there is provided at the inside upper portion of the left frame plate 35*d* a left bearing portion 35*h*L corresponding to the left pivot shaft 53L of the cartridge.

Each of the right bearing portion 35*h*R and the left bearing portion 35*h*L is an U-shaped bearing portion of which a top is opened, and on the occasion when the cartridge is fitted from above into each of the small frame portions 35(1) to 35(4), receives and supports each of the right pivot shaft 53R and the left pivot shaft 53L of the cartridge.

The cartridge urging spring 35*i* is a helical coil spring in this embodiment. In each of the small frame portions 35(1) to 35(4), a coil wound portion of the cartridge urging spring 35*i* is externally fitted onto a boss shaft 35*j*, and supported by the boss shaft 35*j* that is provided at the inside upper portion of the right frame plate 35*e*. Further, one spring arm portion is engaged with the tray 35, and the other spring arm portion is to be a free end portion to extend in parallel with the right frame plate 35*e*. When the cartridge is fitted into each of the small frame portions 35(1) to 35(4) from above, the spring receiving portion 54 of the cartridge is put on the spring arm portion as the above-mentioned free end portion, and elastically supported by the spring arm portion.

In the above-mentioned descriptions, the right bearing portion 35*h*R, the left bearing portion 35*h*L and the spring 35*i* constitute a moving member side supporting portion for supporting the supported portions 53R, 53L and 54 on the cartridge side. That is, the right bearing portion 35*h*R, the left bearing portion 35*h*L and the spring 35*i* constitute a supporting member for supporting the cartridge moveably between the first position and the second position in the state in which the tray 35 is positioned in the inside position.

Figure 15B:
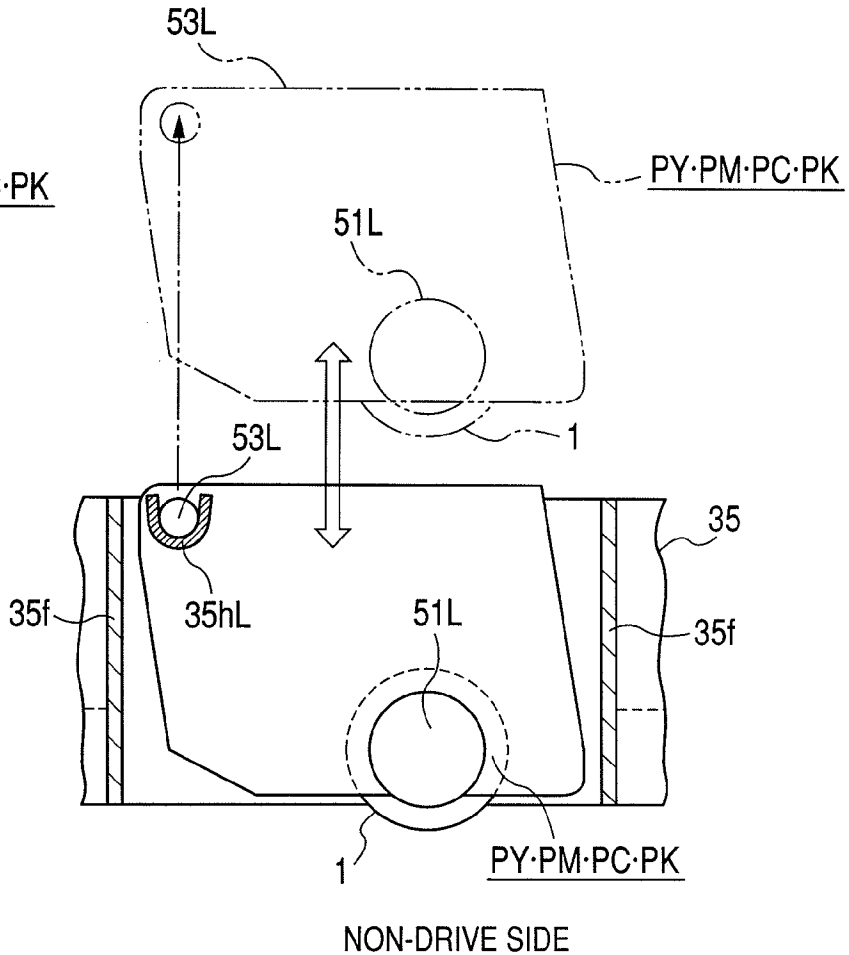
FIGS. 15A and 15B are views of the tray in a cartridge-supporting state (free state).
Figure 15A:
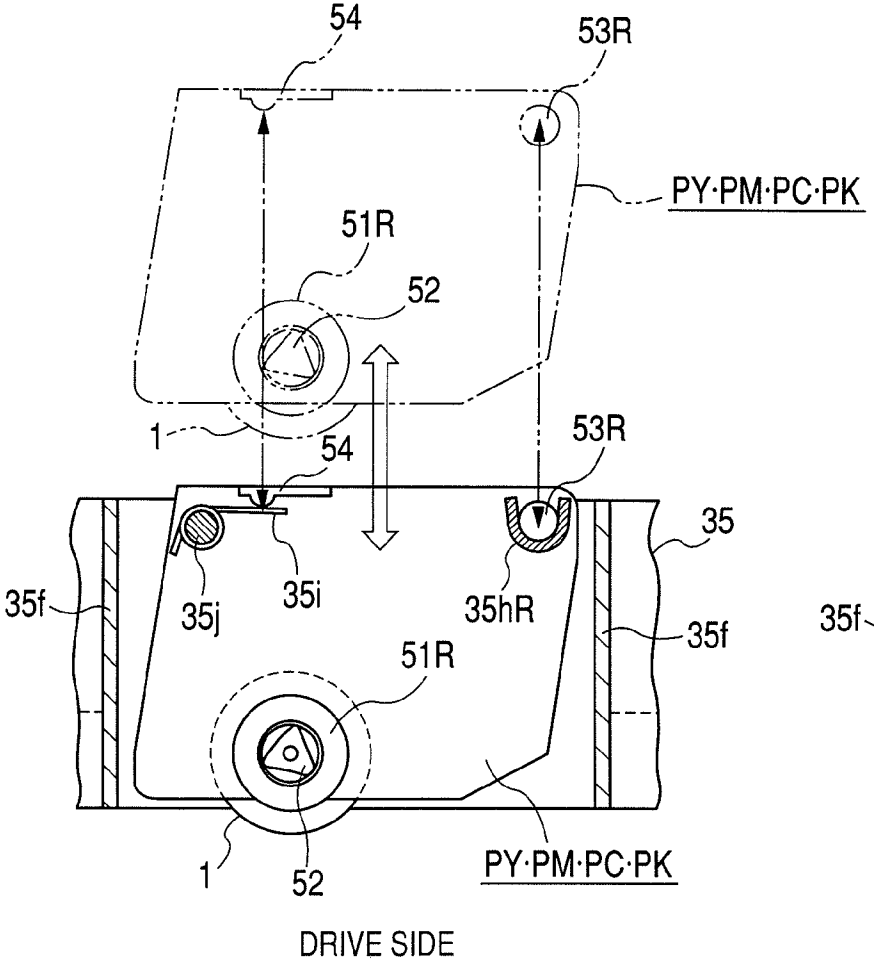

Each cartridge is inserted from above in the corresponding one of the small frame portions 35(1) to 35(4) of the tray 35, and the left and right pivot shafts 53L and 53R are fitted from above into the left and right bearing portions 35*h*L and 35*h*R respectively so as to be supported. Moreover, the spring receiving portion 54 is put on the cartridge urging spring 35*i* and elastically received and supported by the cartridge urging spring 35*i*. That is, each of the cartridge urging springs 35*i* has a spring force (an elastic supporting force) as much as the spring lifts upward the cartridge against the gravitational force of the cartridge. With the arrangement, each cartridge is supported in the corresponding one of the small frame portions 35(1) to 35(4) of the tray 35 without being slipped through the tray 35 to drop downward. In addition, each cartridge that is supported by the tray 35 is supported pivotally in a vertical direction elastically by the provision of elasticity from the cartridge urging spring 35*i* about the left and right pivot shafts 53L and 53R in the corresponding one of the small frame portions 35(1) to 35(4). FIGS. 15A and 15B illustrate the supported state of the cartridge (free state: no external force is acted downward, except for the gravitational force of the cartridge). FIG. 15A is the drive side, and FIG. 15B is the non-drive side. In this state of the cartridge being supported, the spring force of the cartridge urging spring 35*i* is set such that the cartridge is supported in the state (the first position) in which the drum underside is positioned above the level of the upper surface of the belt 13.

The tray 35, as mentioned above, supports the cartridge so as to be capable of taken out right above, and supports the cartridge by moving it directly downward. The tray 35 roughly supports respective cartridges. Owing to this construction, a user can easily replace a cartridge.

In the above-mentioned descriptions, the left and right bearing portions 35*h*L and 35*h*R and the cartridge urging spring 35*i* constitute a supporting member for elastically supporting the cartridges on the tray 35. Furthermore, as described later, in the state in which the tray 35 has been moved in the inside position, the tray 35 supports the cartridge so that the cartridge is moveable between the positioning position where the positioned portion of the cartridge abuts against the apparatus main body side positioning portion, and the positioning releasing position where the positioned portion is separated from the apparatus main body side positioning portion. Moreover, in the free state, the tray 35 supports the cartridge in the positioning releasing position by the elastic supporting force.

(Movement Regulating Member)

The movement regulating member of the tray 35 will be described referring to FIGS. 16 to 18. As illustrated in FIGS. 6 and 7, a user pulls out the tray 35 to the pullout position outside of the apparatus main body A and replaces the cartridge that has to be replaced among the cartridges supported by the tray 35. Then, conversely, after the replacement has completed, the tray 35 is pushed to move to the inside position inside of the apparatus main body A. That is, the tray 35 is returned to the state before being pulled out as illustrated in FIGS. 4A, 4B and 5. Here, each cartridge is held by the tray 35 in the sate in which the underside of the drum 1 is positioned above the upper surface of the belt 13, so that there is no occurrence of friction between the drum underside and the belt 13 in the process of the tray 35 being pushed in and moved. Therefore, occurrence of the scratch and the memory caused by the friction between the drum 1 and the belt 13 can be prevented.

Figure 16:
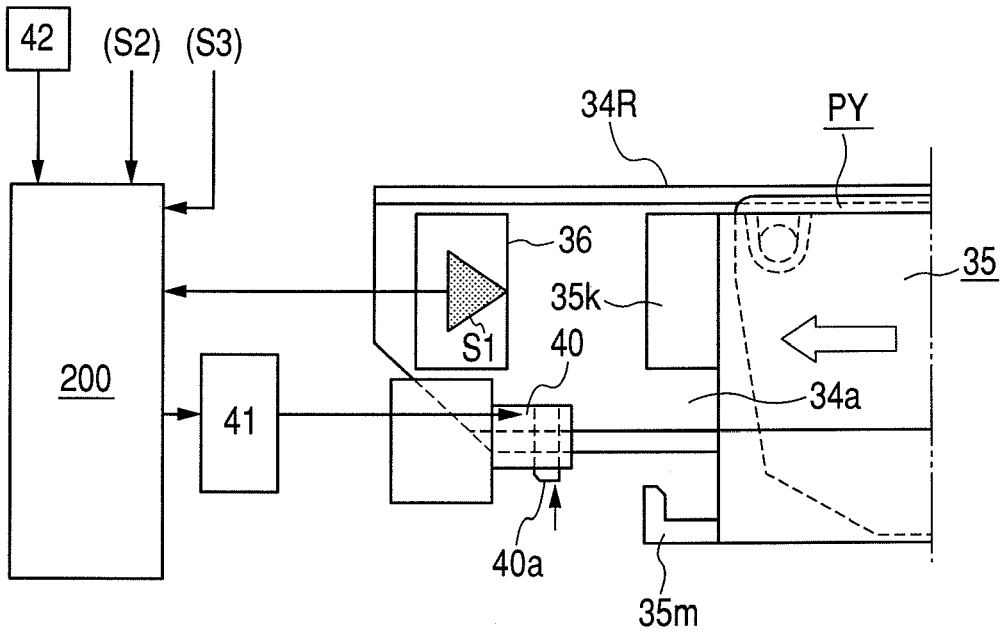
FIG. 16 is an explanatory view of a tray movement regulating member (First).
Figure 17:
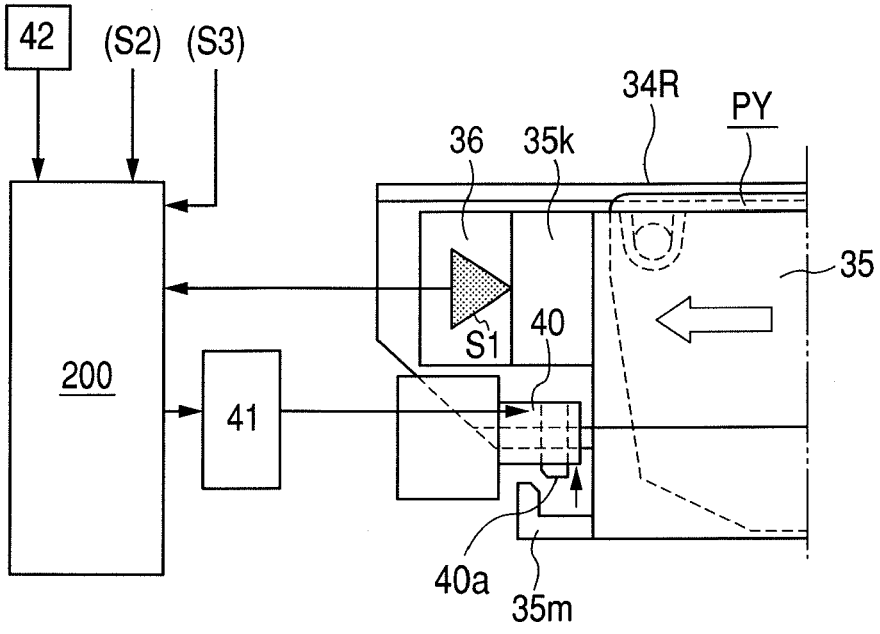
FIG. 17 is an explanatory view of the tray movement regulating member (Second).
Figure 18:
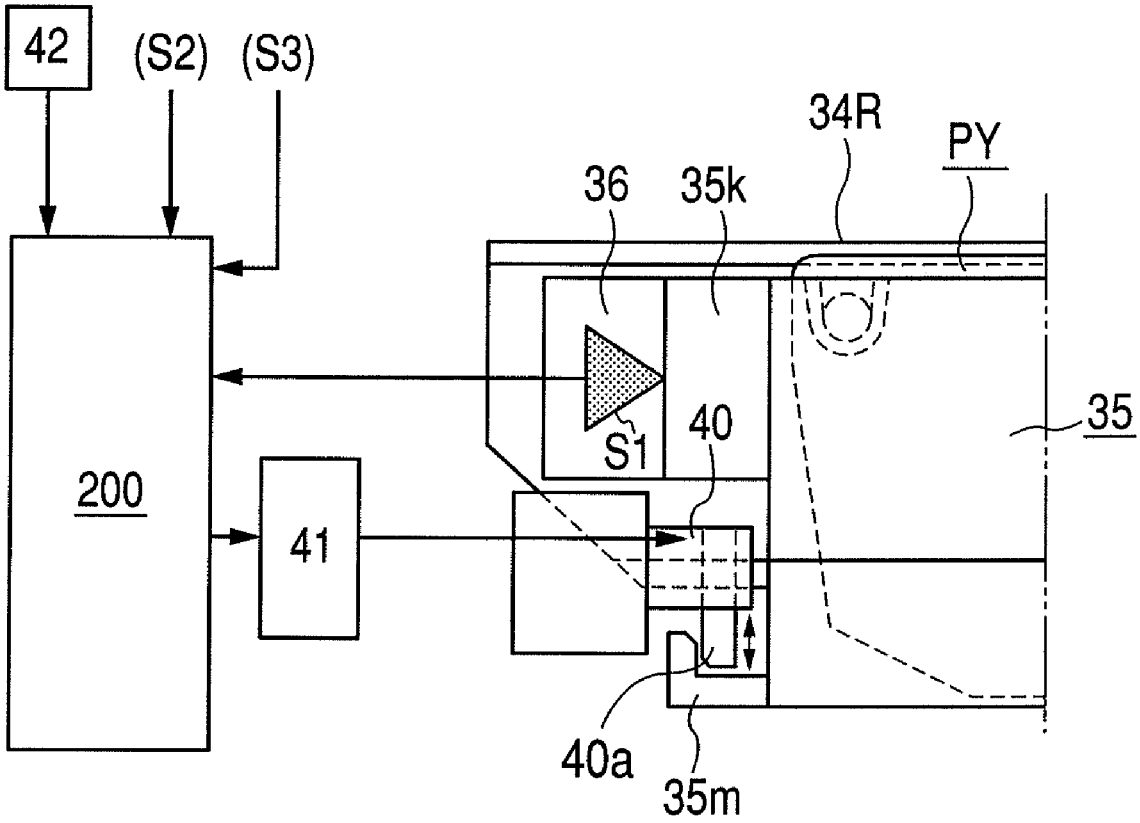
FIG. 18 is an explanatory view of the tray movement regulating member (Third).

When the tray 35 is fully moved to the inside position, a backward extension portion (abutted portion) 35*k* of the right frame plate 35*e* of the tray 35 abuts against an abutting portion 36 and is received by the abutting portion 36 that is provided at a stationary portion on the apparatus main body side (FIG. 16→FIG. 17). Whereby, the tray 35 is prevented form moving to the direction of being pushed further. Moreover, a hook portion 35*m* that is provided on the outside of the back frame plate 35*c* of the tray 35 is positioned below an electromagnetic solenoid 40 that is provided at the stationary portion on the apparatus main body side as the movement regulating member.

When the electromagnetic solenoid 40 is de-energized, a plunger 40*a* is retracted in an internal part of the solenoid by a lifting spring (not illustrated) in the internal part of the solenoid. When the electromagnetic solenoid 40 is energized, the plunger 40*a* protrudes downward from the internal part of the solenoid against the force of the lifting spring.

A tray sensor S1 is provided at the stationary portion of the apparatus main body. This tray sensor S1 is turned off when the backward extension portion 35*k* of the tray 35 is separated from the abutting portion 36, and is turned on when the backward extension portion 35*k* abuts on the abutting portion 36 and is received by the abutting portion 36. Then, when the sensor S1 is turned off, the control circuit portion 200 keeps the turned-off state of a current-carrying circuit 41 for the electromagnetic solenoid 40. When the sensor S1 is turned on, the control circuit portion 200 keeps the turned-on state of the current-carrying circuit 41 for the electromagnetic solenoid 40.

Thus, until the tray 35 is moved to the inside position so that the backward extension portion 35*k* abuts on the abutting portion 36 and is received by the abutting portion 36, the tray sensor S1 is in the OFF-state and the electromagnetic solenoid 40 is in the powered-OFF state. With the arrangement, the plunger 40*a* is held in the state of being retracted in the solenoid interior. Then, when the backward extension portion 35*k* abuts on the abutting portion 36 and is received by the abutting portion 36, the tray sensor S1 is tuned ON and the electromagnetic solenoid 40 is powered ON, whereby the plunger 40*a* is held in the sate of protruding downward from the solenoid interior. Whereby, the plunger 40*a* is engaged with the hook portion 35*m* of the tray 35 (FIG. 17→FIG. 18), and the tray 35 having been moved in the inside position is prevented from moving to the pullout position. That is, the tray 35 is held in the regulated (locked) state in the inside position.

Here, for some reasons, when looking to release the above-mentioned movement regulation of the tray 35, a release switch 42 that is disposed in the proper place of the image forming apparatus is pressed. Thus, even when the tray sensor S1 is in the turned-ON state, the control circuit 200 turns off the electric current from the power supply circuit 41 to the electromagnetic solenoid 40. Whereby, the plunger 40*a* is retracted into the solenoid interior to release the engagement thereof with respect to the hook portion 35*m* (FIG. 18→FIG. 17). That is, the movement regulation of the tray 35 is released, and thus the movement in the pullout direction of the tray 35 is allowed. When the tray 35 is moved in the pullout direction, the backward extension portion 35*k* is separated from the abutting portion 36. Then, the tray sensor S1 is turned off. When the tray 35 is moved to the inside position again so that the backward extension portion 35*k* abuts on the abutting portion 36 and is received by the abutting portion 36, the tray sensor S1 is turned ON, and the electromagnetic solenoid 40 is powered ON. Whereby, the plunger 40*a* is held in the state of protruding downward from the solenoid interior. Thus, the plunger 40*a* is engaged with the hook portion 35*m* of the tray 35, thus preventing the tray 35 having been moved to the inside position again from moving in the pullout direction. That is, the tray 35 is held in the state of regulated in the inside position.

(Pressure Member)

Each cartridge that is held by the tray 35 being regulated in the inside position is held in the positioning releasing position (in the first position) where the drum underside is positioned above the upper surface of the belt 13 by the bearing portions 35*h*L and 35*h*R and the spring 35*i* as described above. FIGS. 19A and 19B illustrate the state of the cartridge being supported.

In this state, the door 31 is turned in the closing direction with respect to the apparatus main body in order to close the opening 30. In conjunction with the closing operation of this door 31, the pressure member performs a pressure operation as described later, and thus each cartridge is pressed downward against the spring force of the spring 35*i*. Thus, as illustrated in FIG. 20, by this pressure force F, each cartridge is pivotally moved downward about the left and right pivot shafts 53L and 53R against the spring force (the elastic supporting force) of the spring 35*i* in the state in which the cartridge is supported by the tray 35. Then, the underside portions (the positioned portions) of the right bearing portion 51R and the left bearing portion 51L of each cartridge abut and are pressed against recesses (apparatus main body side positioning portions) 83R and 83L that are provided in upper sides of a right stay member 82R and a left stay member 82L of the apparatus main body, respectively. Whereby, each cartridge is secured to the positioning position (the second position) of the apparatus main body. In this state, the drum underside of each cartridge is in contact with the upper surface of the belt 13 with stability. In addition, in this state, a power feed system (not illustrated) of the apparatus main body is electrically connected to the electrical contact (not illustrated) of each cartridge with stability. Moreover, in conjunction with the further closing pivotal movement of the door 31, the drive output portion 55 on the apparatus main body side is operated to enter the tray through the hole 35*g* on the drive side of the tray 35 so as to be connected to the coupling fit portion 52 serving as the drive input portion on the cartridge drive side. Incidentally, the illustration of an interlocking mechanism between the door 31 and the drive output portion 55 is omitted. Then, it is detected by a first door switch S2 that the door 31 closes the opening 30 in a predetermined manner. This detection signal is input to the control circuit portion 200, and thus the image forming apparatus is allowed to perform an image forming operation.

In the above-mentioned descriptions, the right bearing portion 35*h*R, the left bearing portion 35*h*L, and the spring 35*i* constitute the moving member side supporting portion. The right pivot shaft 53R, the left pivot shaft 53L, and the spring receiving portion 54 constitute the cartridge side supported portion. The moving member side supporting portion supports the cartridge side supported portion. The pressure member constitute a position converting member that converts the cartridge from the first position (a retracted position) to the second position (a latent image forming position), and converts the cartridge from the second position to the first position.

FIGS. 21 to 27 are views illustrating the pressure member and an operation controller that causes this pressure member to perform a pressure operation and a pressure releasing operation in this embodiment.

Figure 21:
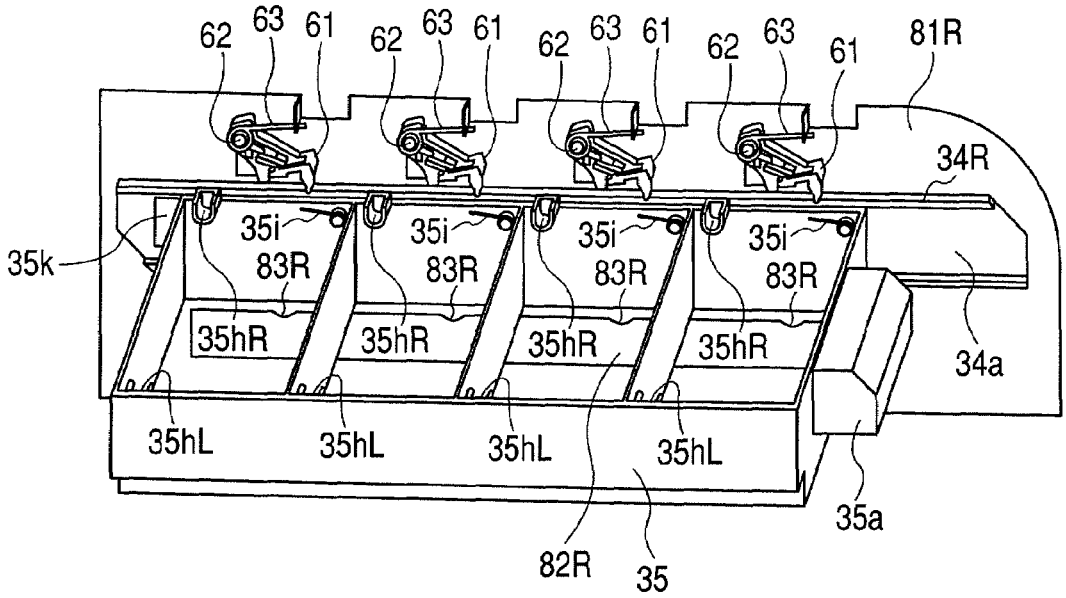
FIG. 21 is an explanatory view of a pressure member.
Figure 22:
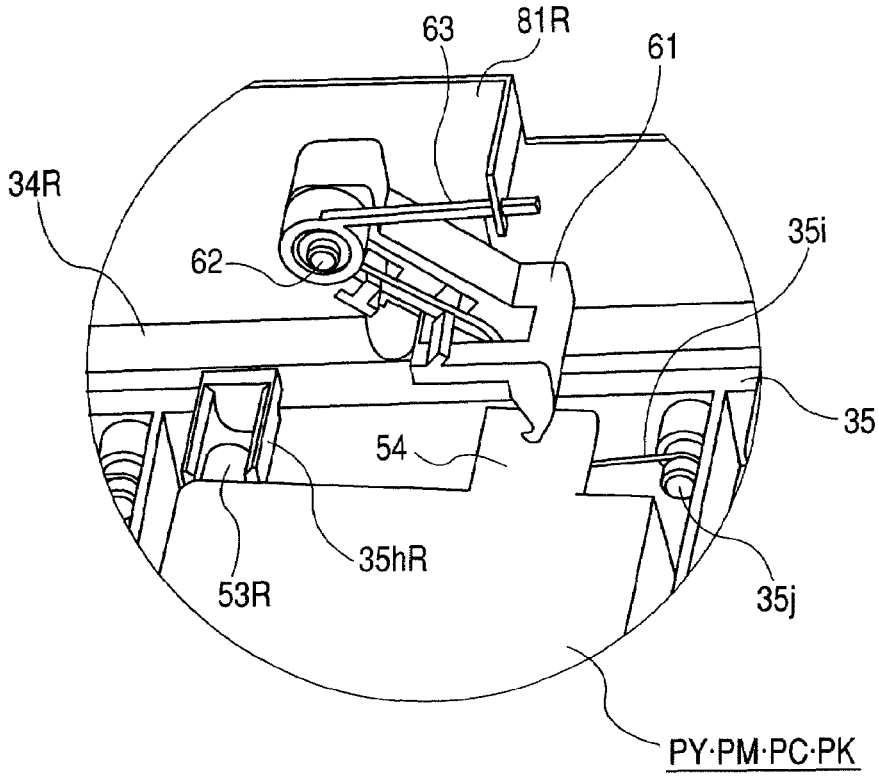
FIG. 22 is a partially enlarged view of FIG. 21.

As illustrated in FIG. 21, on the inside of the right frame (drive side) 81R of the apparatus main body A, four pressing members 61 serving as a pressure member are provided above the right rail member 34R and along the longitudinal direction of this right rail member 34R. Each of these pressing members 61 is located so as to correspond to the upper side of the spring receiving portion 54 of the cartridge when the tray 35 holding the cartridges PY, PM, PC, and PK is positioned in the inside position. Each of the pressing members 61 is supported rotatably about a support shaft 62. In addition, each of the pressing members 61 is urged by a compression spring 63 to rotate in the direction for facing the upper surface of the spring receiving portion 54 of the associated cartridge. FIG. 22 is an enlarged view of one pressing member portion. The compression spring 63 is the spring for rotating the pressing member 61 about the support shaft 62 in the counterclockwise direction indicated by an arrow in FIG. 23, and has a spring force sufficiently larger than that of the above-described cartridge urging spring 35*i*. Therefore, in the state of FIG. 23 in which the pressing member 61 presses downward the upper surface of the spring receiving portion 54 of the cartridge by the urging force of the compression spring 63, the cartridge is moved downward pivotally about the pivot shafts 53L and 53R against the spring force of the spring 35*i* in the state of being supported by the tray 35. Then, as described above, the underside portions (positioned portions) of the left and right bearing portions 51L and 51R of the cartridge abut and are pressed against the recesses (apparatus main body side positioning portions) 83R and 83L of the left and right stay members 82L and 82R on the apparatus main body side, respectively. Whereby, each cartridge is positioned and secured to the apparatus main body. In this state, the drum underside of each cartridge is contacted with the upper surface of the belt 13 with stability. In this state, when the tray 35 is to be slid and pulled out of the apparatus main body, the drum 1 may be scratched or a memory may be left on the drum 1. In this embodiment, however, the movement of the tray 35 is regulated by the movement regulating member 40; and since the door 31 is in the closed state, the tray 35 cannot be pulled out.

Now, the operation controller (cartridge pressing and releasing mechanism and an interface portion around the cartridge) causing the pressing member 61 as the pressure member to perform a pressure operation and a pressure releasing operation will be described. In this embodiment, in conjunction with the opening/closing operations of the door 31, the operation controller controls the pressing member 61 to perform a pressure operation and a pressure releasing operation.

Figure 25:
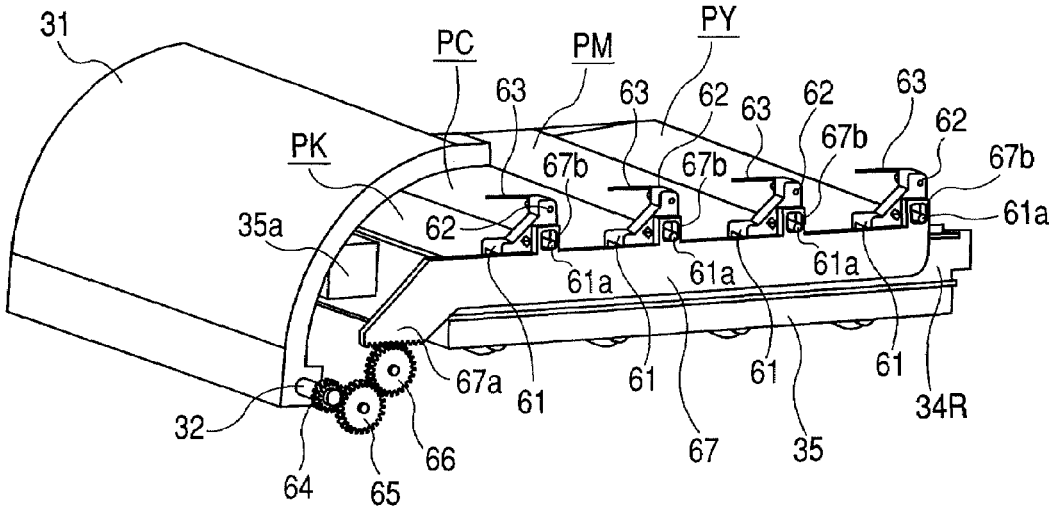
FIG. 25 is an explanatory view of a cartridge pressing and releasing mechanism (First).

FIG. 25 is a perspective view illustrating the entire construction of performing an association operation between the door 31 and the pressing member 61. On a right side end portion (drive side) of the hinge shaft 32, which is a pivot supporting point of the door 31, a drive gear 64 is fixed. The hinge shaft 32 is integral with the door 31 so as to rotate forward and reverse in association with the pivotal opening/closing operation of the door 31. Therefore, the drive gear 64 also makes a forward and reverse rotation in association with the pivotal opening/closing operation of the door 31. Moreover, idler gears 65 and 66 for meshing with the drive gear 64 to transmit a driving force are rotatably supported by shafts on a side plate (not illustrated). The idler gear 66 is meshed with a rack-shaped portion 67*a* of a separation rod 67. The separation rod 67 is held and located so as to be capable of sliding in the front-back direction on the outer surface side of the right frame 81R of the apparatus main body A. Thus, the driving force is transmitted from the drive gear 64, which rotates forward and reverse in association with the pivotal opening/closing operation of the door 31, through the idler gears 65 and 66 and the rack-shaped portion 67*a* to the separation rod 67 so that the separation rod 67 is driven to move in the front and back directions. The separation rod 67 has shaped portions 67*b* that are contacted with boss-shaped portions 61*a* of the respective pressing members 61 to rotate and restore the pressing members 61 against the spring force of the compression spring 63. Accordingly, in conjunction with the sliding operation in the front-back directions of the separation rod 67 by the forward and reverse rotations of the idler gear 66 in association with the pivotal opening/closing operations of the door 31, the pressing member 61 is rotated forward and reverse.

Figure 26:
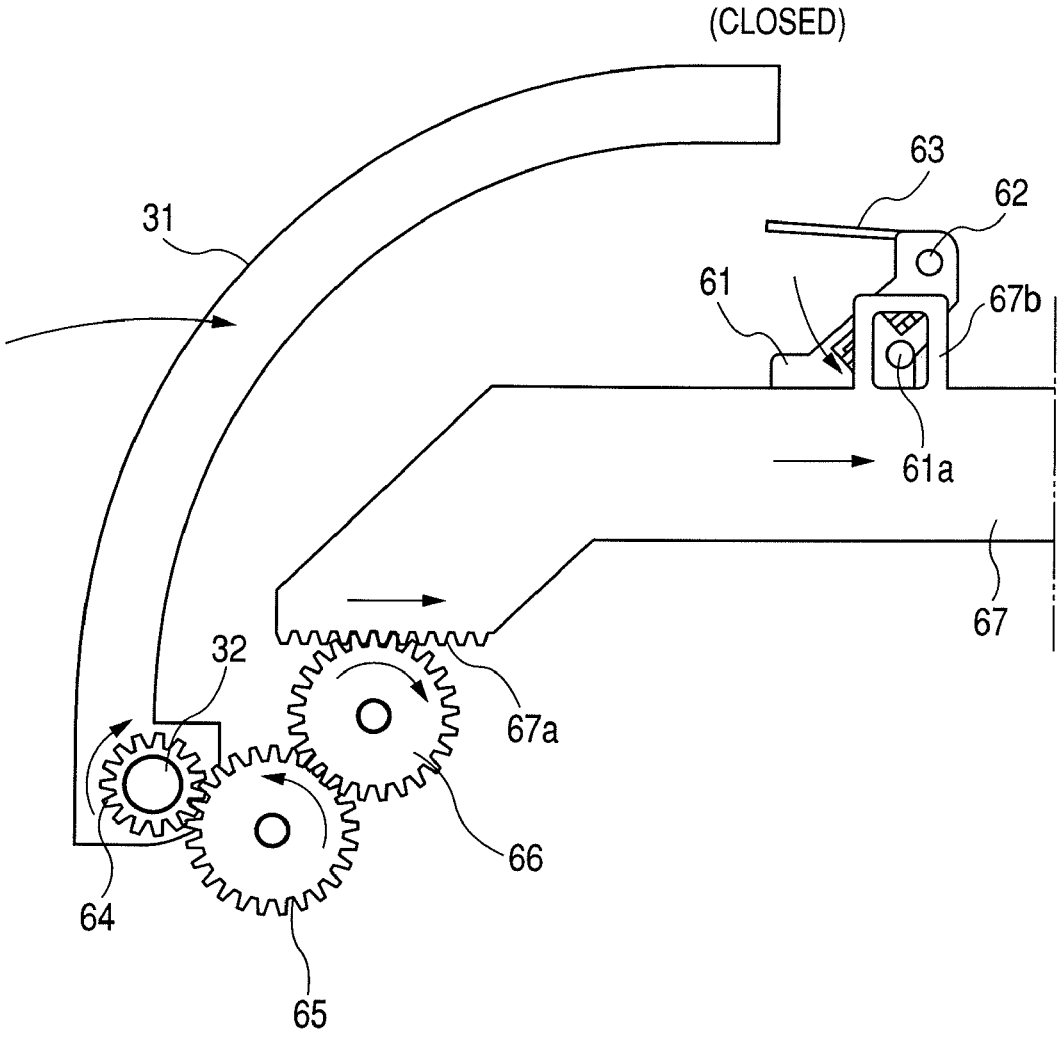
FIG. 26 is an explanatory view of the cartridge pressing and releasing mechanism (Second).
Figure 27:
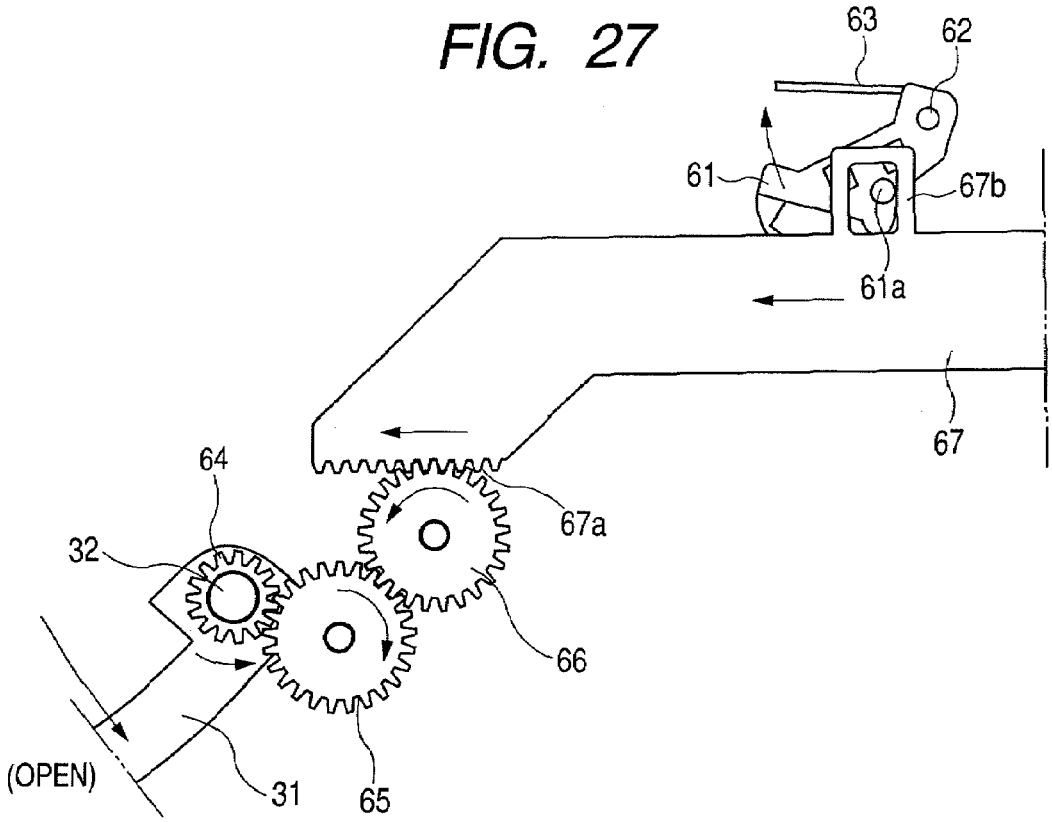
FIG. 27 is an explanatory view of the cartridge pressing and releasing mechanism (Third).
Figure 28:
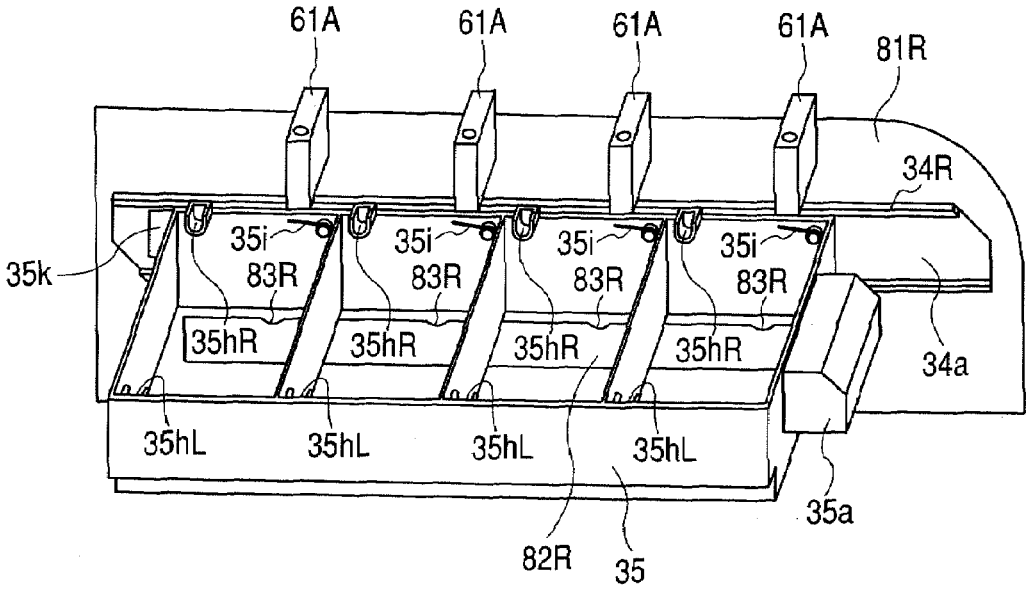
FIG. 28 is a view using an electromagnetic solenoid as a pressure member.
Figure 29:
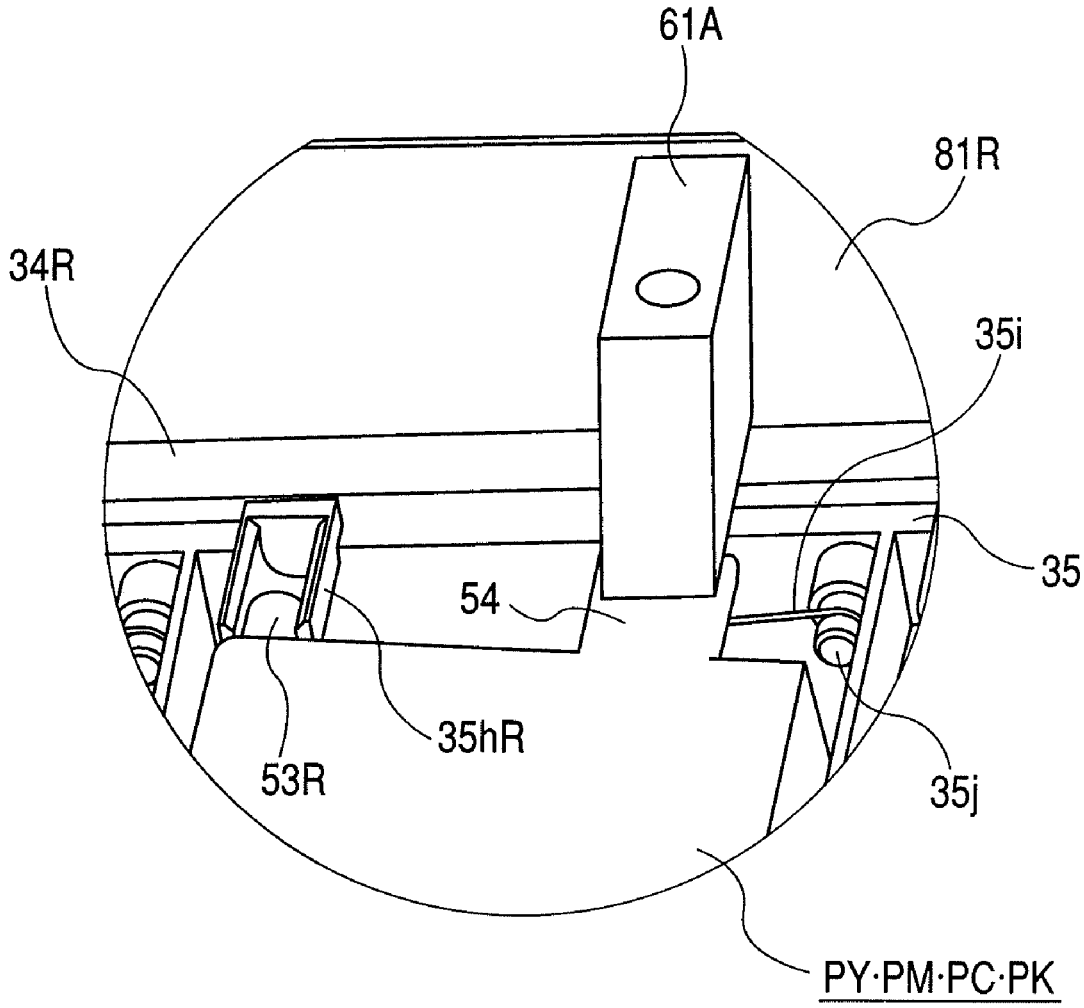
FIG. 29 is a partially enlarged view of FIG. 28.
Figure 30:
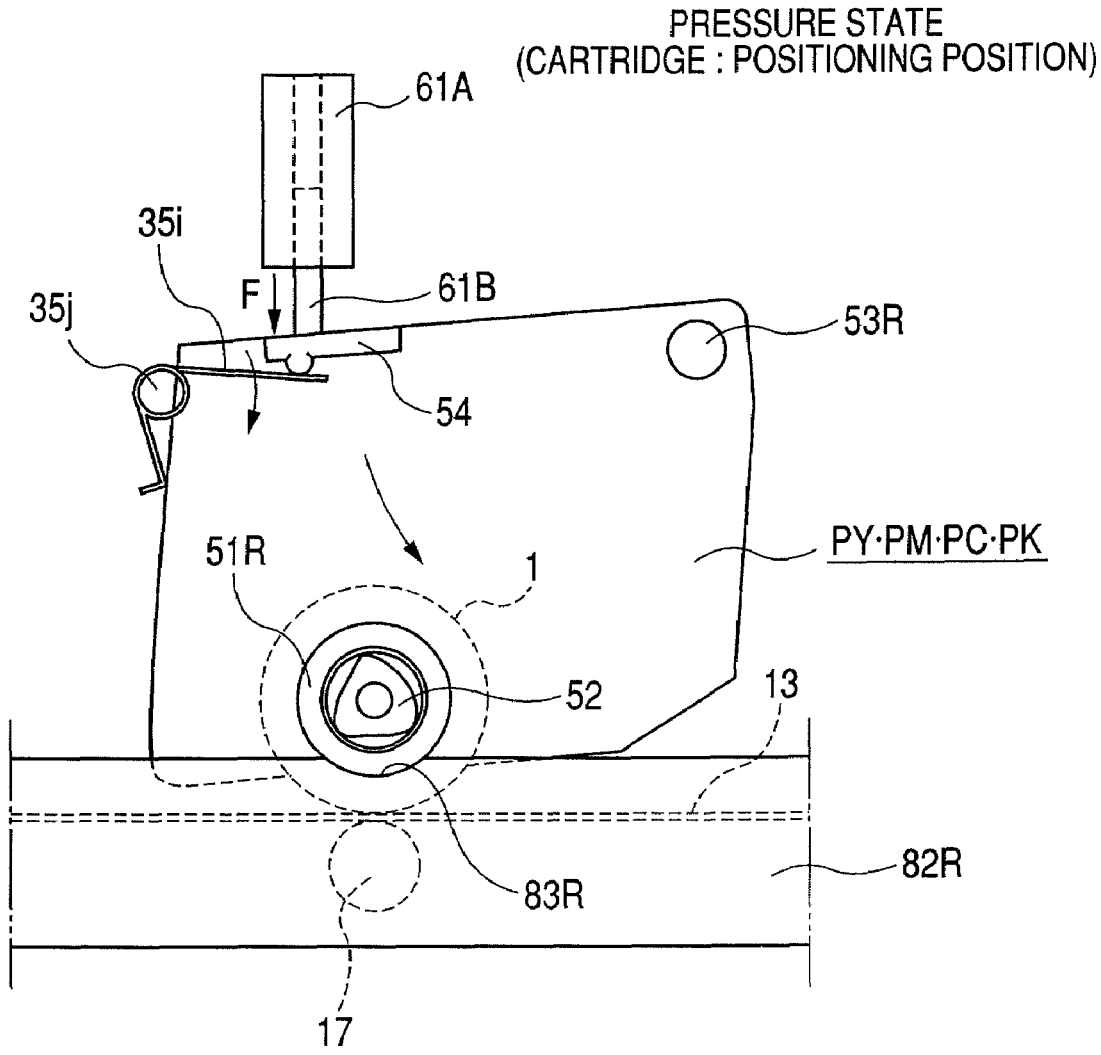
FIG. 30 is a state view in a pressure operation.
Figure 31:
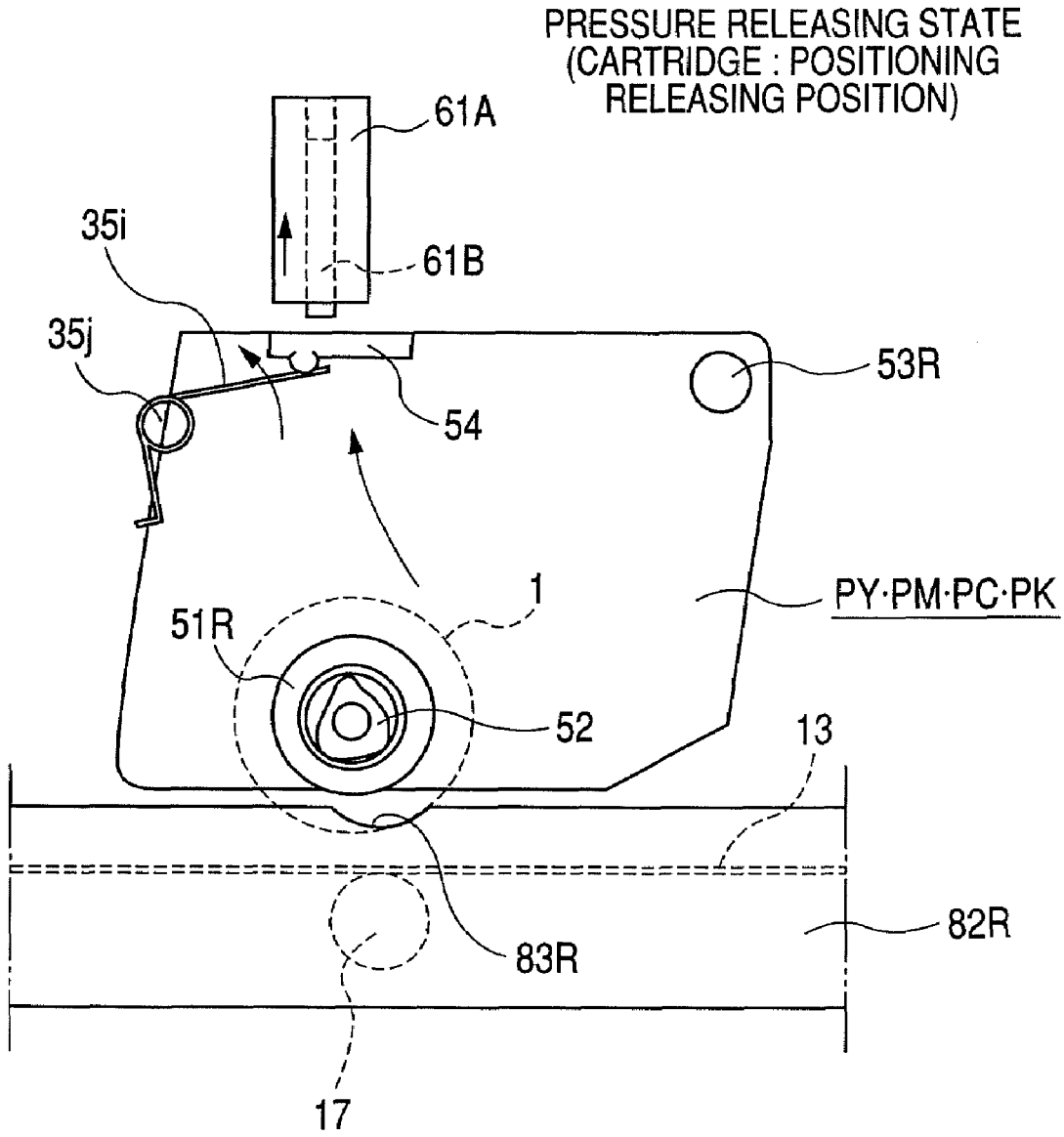
FIG. 31 is a state view in a pressure releasing operation.

FIG. 26 is a view illustrating the state of the pressing member 61 when the door 31 is closed. FIG. 27 is a view illustrating the state of the pressing member 61 when the door 31 is opened.

Figure 20A:
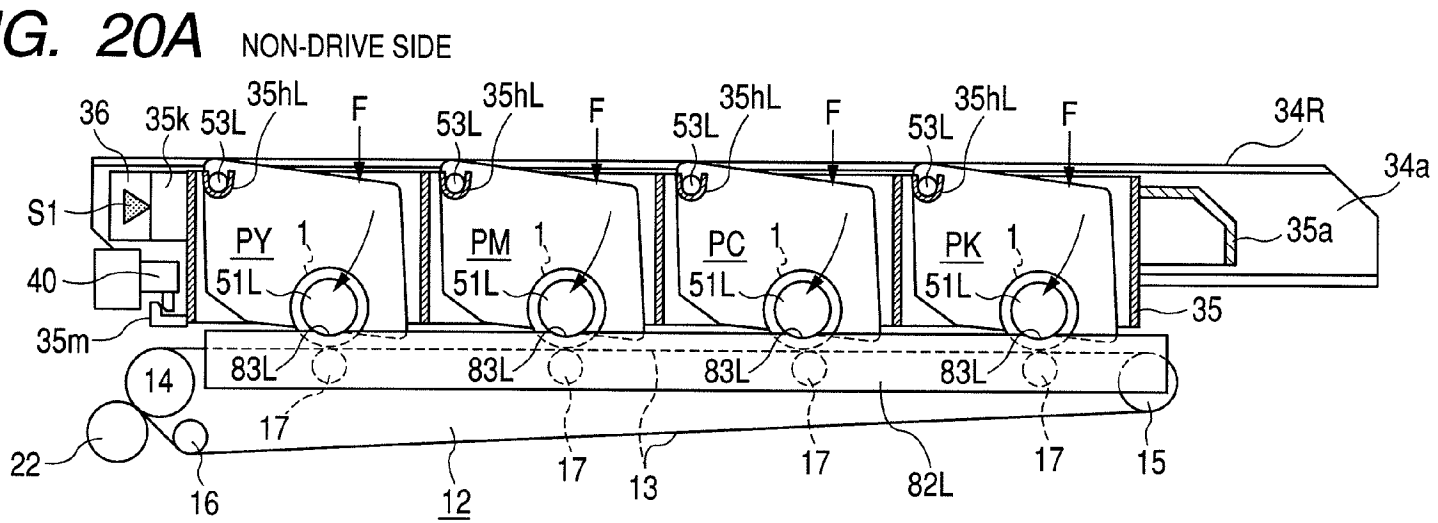
FIGS. 20A and 20B are views illustrating the state in which the tray is in an inside position, and the cartridge that is supported by the tray is pressed to be in a positioning position.
Figure 20B:
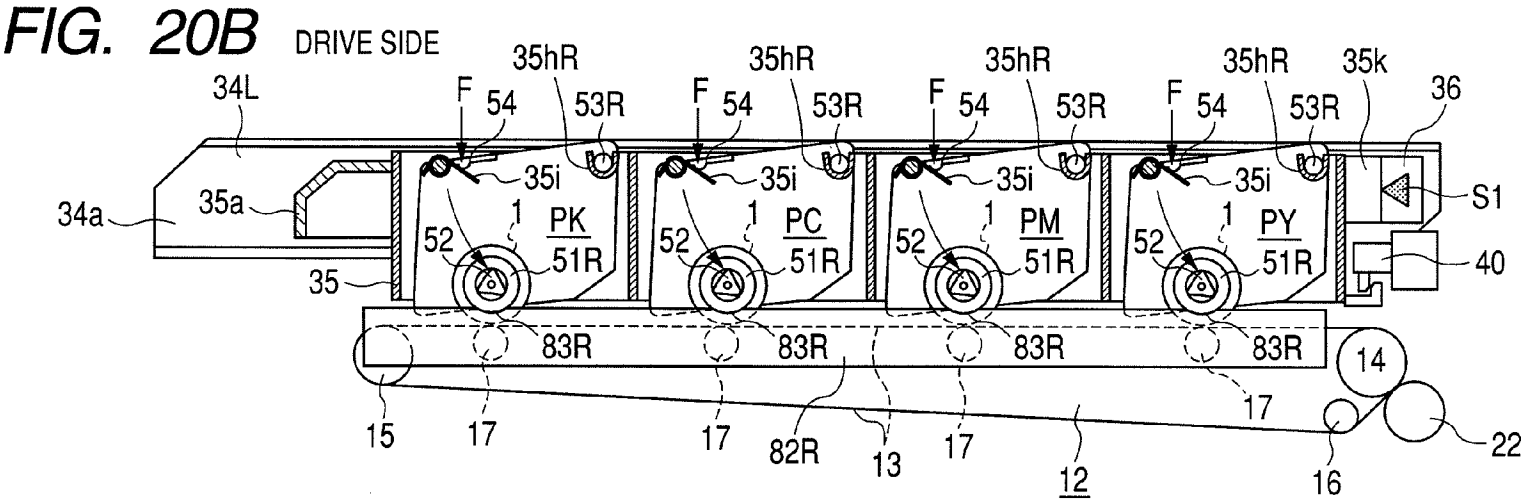
Figure 23:
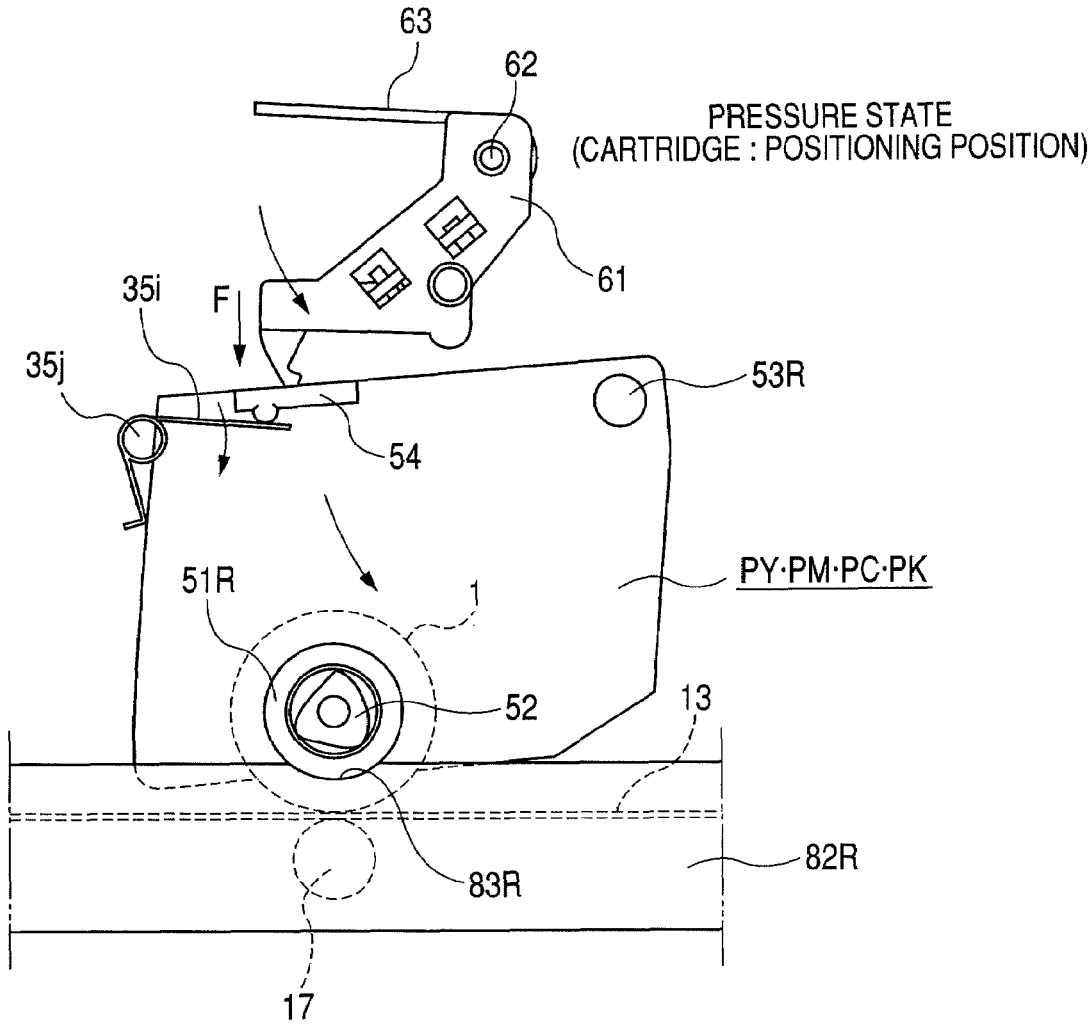
FIG. 23 is a state view in a pressure operation.

In the state of FIG. 26 in which the door 31 is closed with respect to the apparatus main body A, the shaped portion 67*b* of the separation rod 67 for pushing back and rotating the pressing member 61 is not contacted with the boss 61*a* of the pressing member 61. Therefore, the pressing member 61 presses (performs a pressure operation) downward the upper surface of the spring receiving portion 54 of the corresponding cartridge by the spring force of the compression spring 63 (FIG. 23). Whereby, as shown in FIGS. 20A and 20B, each cartridge is held in the state of being positioned and secured (in the positioning position) with respect to the apparatus main body. According to this embodiment, thus, the process cartridge can be positioned with respect to the apparatus main body A with high accuracy. According to this embodiment, in addition to improving the mounting/dismounting operability for mounting/dismounting the process cartridge on the apparatus main body, the process cartridge can be positioned with respect to the apparatus main body with high accuracy.

Figure 24:
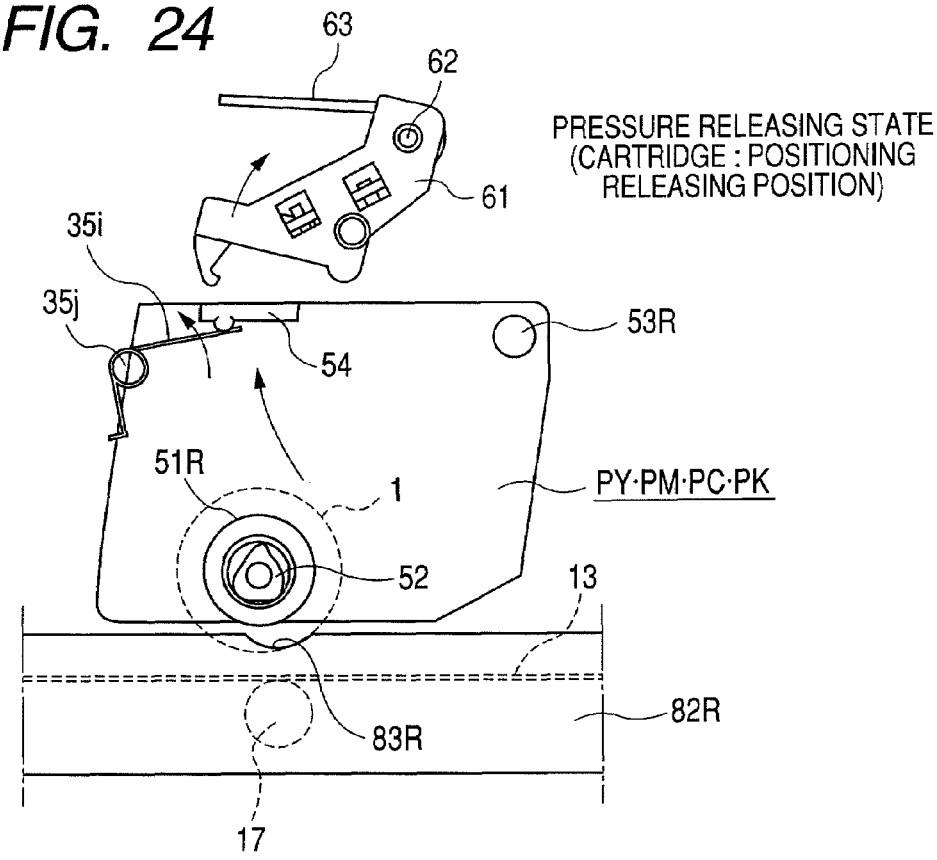
FIG. 24 is a state view in a pressure releasing operation.

In the state of FIG. 27 in which the door 31 is opened from the apparatus main body A, the shaped portion 67*b* of the separation rod 67 for pushing back and rotating the pressing member 61 is contacted with the boss 61*a* of the pressing member 61. That is, the separation rod 67 of which the shaped portion 67*b* has not been contacted with the boss 61*a* of the pressing member 61 in the state of FIG. 26 in which the door 31 is closed, is moved to the left in FIG. 27 in the state in which the door 31 is opened. Whereby, the shaped portion 67*b* is contacted with the boss 61*a* of the pressing member 61 to press the boss 61*a*. By this pressure, the pressing member 61 is pressed leftward in FIG. 27 by the separation rod 67, and pushed back and rotated about the support shaft 62 against the spring force of the compression spring 63. With the arrangement, the downward pressure of the pressing member 61 to the spring receiving portion 54 of the cartridge is released (the pressure releasing operation) (FIG. 24). By this pressure releasing operation, each cartridge is returned to the state, as illustrated in the above-described FIGS. 19A and 19B, in which each cartridge is held by the tray 35 in the state (the positioning releasing position) in which the drum underside is positioned above the upper surface of the belt 13 by the cartridge urging spring 35*i*.

Here, in this embodiment, in conjunction with the pivotal opening operation of the door 31, first the connection between the drive output portion of the apparatus main body side and the drive input portion of each cartridge is released (an illustration of an interlocking mechanism between the door 31 and the drive output portion 55 is omitted in the drawings). Then, in conjunction with the further pivotal opening operation of the door 31, the above-mentioned pressure releasing operation of the pressure member 61 is performed. Furthermore, by the movement of the cartridge to the positioning releasing position in association with this pressure releasing operation, the conduction between the electrical contact of the cartridge and the power feed system on the apparatus main body side is shut off. Then, when the door 31 is fully opened after the pressure member 61 performs the pressure releasing operation, a second door switch S3 detects that the door 31 is opened. In response to a signal from this second door switch S3, the control circuit portion 200 turns off electricity to the electromagnetic solenoid 40 as a movement regulating member. Whereby, the regulation of the tray 35 is released to allow the pulling-out-movement of the tray 35.

Owing to the above-described arrangement, in conjunction with the opening/closing operation of the door 31, the application of pressure and the release of pressure to each of the cartridges PY, PM, PC, and PK that is held by the tray 35 in the inside position are made, and the abutment and the separation of the drum 1 with respect to the belt 13 is made. Further, only when the door 31 is opened, the drum 1 is separated from the belt 13, thus enabling the operation of pulling out the tray 35. Consequently, the scratch and memory of the drum caused by the friction at the time of abutment can be prevented.

As described above, to improve usability, the cartridge is put on the tray, and the cartridge is replaced. Furthermore, at the time of replacement of the cartridge, the tray needs not to be moved vertically. Therefore, it is possible to provide a user with an image forming apparatus provided with a cartridge replacement arrangement of the pullout type in which the increase of costs and an apparatus main body size is minimized, as well as the production of the scratch and the memory due to the friction between the belt 13 and the cartridge (drum) is prevented.

The mechanism of pressing and releasing the cartridge in conjunction with the opening/closing operation of the door 31, as in this embodiment, may not be the arrangement in which the drive gear 64 is provided on the hinge shaft 32 of the door 31, and the separation rod 67 having the rack-shaped portion 67*a* is slid. For example, the one that employs a cam or a link mechanism can be used.

Moreover, the pressure member may not be the construction according to this embodiment. For example, as illustrated in FIGS. 28, 29, 30 and 31, the construction of employing an electromagnetic solenoid 61A can be used as the pressure member. That is, by energizing the electromagnetic solenoid 61A, a plunger 61B is protruded to press the cartridge, while by de-energizing the electromagnetic solenoid 61A, the plunger 61B is retracted to release the pressure to the cartridge. ON (pressure operation) and OFF (pressure releasing operation) of the electrification of the electromagnetic solenoid can be performed by a switch, which is turned off and turned on in conjunction with the opening and closing operations of the door 31.

The operation controller causing the pressure member 61 or 61A to perform a pressure operation and a pressure releasing operation may not be configured to associate with the opening/closing operation of the door 31. This operation controller may be a dedicated lever or an electrical switch for causing the pressure member 61 to make a pressure operation and a pressure releasing operation.

The cartridge urging spring 35*i* of the tray 35, the spring receiving portion 54 of the cartridge, and the pressure member 61 or 61A of the apparatus main body may not be located on the drive side, but on the non-drive side, or may be located both on the drive side and on the non-drive side.

In the above-mentioned embodiment, the right bearing portion 35*h*R, the left bearing portion 35*h*L and the spring 35*i* constitute a supporting member for supporting the cartridge so as to be moveable between the first position (retracted position) and the second position (latent image forming position) in the state in which the tray 35 is positioned in the inside position. Furthermore, the pressure member is a position converting member for converting the cartridge from the first position to the second position, and converting the cartridge from the second position to the first position. Further, the supporting member and the position converting member constitute a moving device for moving the cartridge between the first position in which the cartridge is retracted from the latent image forming position and the second position in which the cartridge is positioned in the latent image forming position in the state in which the tray (moving member) 35 is positioned in the inside position.

Due to that in the state in which the tray 35 is positioned in the inside position, the cartridge is moved between the first position in which the cartridge is retracted from the latent image forming position and the second position in which the cartridge is positioned in the latent image forming position, the moving mechanism of the tray 35 can be simplified.

The cartridge, in the state in which the tray 35 is positioned in the inside position, is moved between the first position for retracting the cartridge from the latent image forming position and the second position for positioning the cartridge in the latent image forming position. Whereby, the tray 35 needs not to be moved between the position of retracting the cartridge from the latent image forming position and the position of positioning the cartridge in the latent image forming position.

The construction of the above-mentioned moving device is not limited to such construction of the above-mentioned embodiment. The moving device can be, for example, the following construction. A tray as a moving member is provided with a moveable supporting member such as a pin shaft that can move between the supporting position for supporting a cartridge in a first position and the non-supporting position not for supporting the cartridge. Furthermore, the moveable supporting member that is moved in the supporting position is made to support the cartridge, and is supported by the tray. There is provided an interlocking mechanism for moving the moveable supporting member from the supporting position to the non-supporting position in conjunction with the closing operation of the opened door 31 in the state in which the tray is positioned in the inside position. By moving the moveable supporting member from the supporting position to the non-supporting position, the cartridge is moved to a second position by the gravitational force of the cartridge. In addition, there is provided an interlocking mechanism for lifting up the cartridge resided in the second position by a lift member to return the cartridge to the first position in conjunction with the opening operation of the closed door 31 in the state in which the tray is positioned in the inside position. There is provided an interlocking mechanism for moving the moveable supporting member from the non-supporting position to the supporting position to support the cartridge having been returned to the first position in conjunction with the further opening operation of the door 31. There is provided an interlocking mechanism of causing the above-mentioned lift member to return in conjunction with the further opening operation of the door 31.

Although the electrophotographic image forming apparatus according to this embodiment uses four cartridges, the number of cartridges used is not limited to four. The tray 35 can support a plurality of cartridges arranged along the moving direction. Furthermore, the image forming apparatus may use only one cartridge. In this case, the tray 35 is adapted to support only one cartridge.

According to the embodiment of the present invention, a process cartridge can be positioned with high accuracy in a simple construction in an apparatus main body, and an electrophotographic image forming apparatus in which the process cartridge is detachably mountable can be provided.

Furthermore, according to the embodiment of the present invention, a process cartridge can be improved in a mounting/dismounting operability of mounting and dismounting the process cartridge with respect to the apparatus main body, and an electrophotographic image forming apparatus in which the process cartridge is detachably mountable can be provided.

Moreover, according to the embodiment of the present invention, a process cartridge can be improved in the mounting/dismounting operability of mounting and dismounting the process cartridge with respect to the apparatus main body, and furthermore, the process cartridge can be positioned with high accuracy in the apparatus main body, and an electrophotographic image forming apparatus in which the process cartridge is detachably mountable can be provided.

According to the embodiment of the present invention, the process cartridge, in the state in which a moving member is positioned in the inside position, is moved between the first position for retracting the process cartridge from the latent image forming position and the second position for positioning the process cartridge in the latent image forming position, and thus, the moving mechanism of the moving member can be simplified.

According to the embodiment of the present invention, the process cartridge, in the state in which the moving member is positioned in the inside position, is moved between the first position for retracting the process cartridge from the latent image forming position and the second position for positioning the process cartridge in the latent image forming position. Whereby, the moving member needs not to be moved between the position for retracting the process cartridge from the latent image forming position and the position for positioning the process cartridge in the latent image forming position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-263056, filed Oct. 9, 2007, which is hereby incorporated by reference herein in its entirety.

What is claimed is:

1. An electrophotographic image forming apparatus in which a process cartridge including an electrophotographic photosensitive drum and a process member acting on the electrophotographic photosensitive drum is detachably mounted to an apparatus main body of the electrophotographic image forming apparatus to form an image on a recording medium, the electrophotographic image forming apparatus comprising:

a moving member, which is slidably held by a rail member fixedly disposed in the apparatus main body, and which supports the process cartridge and assumes a pullout position in which the moving member is pulled out outside of the apparatus main body so that the process cartridge is moved outside of the apparatus main body, and an inside position for moving the process cartridge inside the apparatus main body;

a movement regulating member, which regulates the moving member having been moved to the inside position in the inside position, and releases a regulation; and a moving device, which moves the process cartridge between a supporting position in which the process cartridge is supported by the moving member and an image forming position for an image formation, with respect to the moving member in a state in which the moving member is positioned in the inside position and regulated by the movement regulating member.

2. An electrophotographic image forming apparatus according to claim 1, wherein the supporting position is a positioning releasing position in which a positioned portion of the process cartridge is separated from an apparatus main body side positioning portion, and the image forming position is a positioning position in which the positioned portion abuts against the apparatus main body side positioning portion.

3. An electrophotographic image forming apparatus according to claim 1, further comprising a position converting member, which converts the process cartridge from the supporting position to the image forming position, and which converts the process cartridge from the image forming position to the supporting position.

4. An electrophotographic image forming apparatus according to claim 1, wherein the moving member supports a plurality of process cartridges arranged along a moving direction of the moving member.

5. A process cartridge, which is detachably mountable to a moving member of an electrophotographic image forming apparatus to which the process cartridge is detachably mountable to form an image on a recording medium, the electrophotographic image forming apparatus including: the moving member, which is slidably held by a rail member fixedly disposed in the apparatus main body of the electrophotographic image forming apparatus, and which supports the process cartridge and assumes a pullout position in which the moving member is pulled out outside of the apparatus main body so that the process cartridge is moved outside of the apparatus main body, and an inside position for moving the process cartridge inside the apparatus main body; a movement regulating member, which regulates the moving member having been moved to the inside position in the inside position, and releases a regulation: and a moving device, which moves the process cartridge between a supporting position in which the process cartridge is supported by the moving member and an image forming position for an image formation, with respect to the moving member in a state in which the moving member is positioned in the inside position and regulated by the movement regulating member, the process cartridge comprising:

an electrophotographic photosensitive drum;

a process member acting on the electrophotographic photosensitive drum; and a supported portion to be supported by a moving member side supporting portion so that the process cartridge assumes the supporting position and the image forming position in the state in which the moving member is positioned in the inside position.

6. An electrophotographic image forming apparatus in which a process cartridge including an electrophotographic photosensitive drum and a process member acting on the electrophotographic photosensitive drum is detachably mounted to an apparatus main body of the electrophotographic image forming apparatus to form an image on a recording medium, the electrophotographic image forming apparatus comprising:

a moving member, which is slidably held by a rail member fixedly disposed in the apparatus main body, supports the process cartridge, and assumes a pullout position in which the moving member is pulled out outside of the apparatus main body so that the process cartridge is moved outside of the apparatus main body, and an inside position for moving the process cartridge inside the apparatus main body;

a movement regulating member, which regulates the moving member having been moved to the inside position in the inside position, and releases a regulation:

a supporting member, which supports the process cartridge so as to be moveable between an image forming position for an image formation in which a positioned portion is positioned by abutting against a positioning portion provided on the apparatus main body, and a retracted position in which the process cartridge is retracted from the image forming position, with respect to the moving member in a state in which the moving member is positioned in the inside position and regulated by the movement regulating member; and a position converting member, which converts the process cartridge from the retracted position to the image forming position, and reversely, converts the process cartridge from the image forming position to the retracted position.

7. A process cartridge, which is detachably mountable to a moving member of an electrophotographic image forming apparatus to which the process cartridge is detachably mountable to form an image on a recording medium, the electrophotographic image forming apparatus including: the moving member, which is slidably held by a rail member fixedly disposed in an apparatus main body of the electrophotographic image forming apparatus, supports the process cartridge, and assumes a pullout position in which the moving member is pulled out outside of the apparatus main body so that the process cartridge is moved outside of the apparatus main body, and an inside position for moving the process cartridge inside the apparatus main body; a movement regulating member, which regulates the moving member having been moved to the inside position in the inside position, and releases a regulation; a supporting member, which supports the process cartridge so as to be moveable between an image forming position in which a positioned portion is positioned by abutting against a positioning portion provided on the apparatus main body, and a retracted position in which the process cartridge is retracted from the image forming position, with respect to the moving member in a state in which the moving member is positioned in the inside position and regulated by the movement regulating member; and a position converting member, which converts the process cartridge from the retracted position to the image forming position, and reversely, converts the process cartridge from the image forming position to the retracted position, the process cartridge comprising:

an electrophotographic photosensitive drum;

a process member acting on the electrophotographic photosensitive drum; and a supported portion supported by the supporting member.

8. An electrophotographic image forming apparatus in which a process cartridge including an electrophotographic photosensitive drum and a process member acting on the electrophotographic photosensitive drum is detachably mounted to an apparatus main body of the electrophotographic image forming apparatus to form an image on a recording medium, the electrophotographic image forming apparatus comprising:

an opening through which the process cartridge passes to be inserted into an inside of the apparatus main body, and to be taken out from the inside of the apparatus main body;

a moving member, which is slidably held by a rail member fixedly disposed in the apparatus main body, supports the process cartridge, and is moveable in a direction intersecting an axial direction of the electrophotographic photosensitive drum of the process cartridge, the moving member assuming a pullout position in which the moving member is pulled out outside of the apparatus main body through the opening so that the process cartridge is moved outside of the apparatus main body, and an inside position for moving the process cartridge inside the apparatus main body;

a movement regulating member, which regulates the moving member having been moved to the inside position in the inside position, and releases a regulation;

a supporting member, which supports the process cartridge at the moving member, the supporting member elastically supporting the process cartridge so as to be moveable between a positioning position in which a positioned portion of the process cartridge abuts against an apparatus main body side positioning portion, and a positioning releasing position in which the positioned portion is separated from the apparatus main body side positioning portion in a state in which the moving member has been moved in the inside position and regulated by the movement regulating member, and the supporting member supporting the process cartridge in the positioning releasing position by an elastic supporting force in a free state; and a pressure member, which presses the process cartridge against the elastic supporting force to move the process cartridge from the positioning releasing position to the positioning position in the state in which the moving member has been moved in the inside position.

9. An electrophotographic image forming apparatus according to claim 8, further comprising an operation controller causing the pressure member to perform a pressure operation and a pressure releasing operation.

10. An electrophotographic image forming apparatus according to claim 8, further comprising an openable and closable door member, which assumes a closing position for closing the opening and an opening position for opening the opening, wherein the pressure member performs a pressure operation in conjunction with a closing operation of the door member and performs a pressure releasing operation in conjunction with an opening operation of the door member.

11. An electrophotographic image forming apparatus according to claim 8, further comprising an openable and closable door member, which assumes a closing position for closing the opening and an opening position for opening the opening, wherein the pressure member performs a pressure operation in conjunction with a closing operation of the door member and performs a pressure releasing operation in conjunction with an opening operation of the door member, and the movement regulating member performs an operation of releasing the regulation after the pressure member performs the pressure releasing operation.

12. An electrophotographic image forming apparatus according to claim 8, wherein the moving member is moved in a horizontal direction, supports the process cartridge so as to be taken out right above in the pullout position, and supports the process cartridge by moving the process cartridge directly downward.

13. An electrophotographic image forming apparatus according to claim 12, wherein the moving member supports a process cartridge containing a black developer, a process cartridge containing a cyan developer, a process cartridge containing a magenta developer, and a process cartridge containing a yellow developer arranged in order of mention, from an upstream side to a downstream side in a moving direction of the moving member from the outside to the inside of the opening.

14. A process cartridge, which is detachably mountable to a moving member of an electrophotographic image forming apparatus in which the process cartridge is detachably mountable to an apparatus main body of the electrophotographic image forming apparatus to form an image on a recording medium, the electrophotographic image forming apparatus including: an opening through which the process cartridge passes to be inserted into an inside of the apparatus main body, and to be taken out from the inside of the apparatus main body; a moving member, which is slidably held by a rail member fixedly disposed in the apparatus main body, supports the process cartridge, and is moveable in a direction intersecting an axial direction of an electrophotographic photosensitive drum of the process cartridge, the moving member assuming a pullout position in which the moving member is pulled out outside of the apparatus main body through the opening so that the process cartridge is moved outside of the apparatus main body, and an inside position for moving the process cartridge inside the apparatus main body; a movement regulating member, which regulates the moving member having been moved to the inside position in the inside position, and releases a regulation; a supporting member, which supports the process cartridge at the moving member, the supporting member elastically supporting the process cartridge so as to be moveable between a positioning position in which a positioned portion of the process cartridge abuts against an apparatus main body side positioning portion, and a positioning releasing position in which the positioned portion is separated from the apparatus main body side positioning portion in a state in which the moving member has been moved in the inside position and regulated by the movement regulating member, and the supporting member supporting the process cartridge in the positioning releasing position by an elastic supporting force in a free state; and a pressure member, which presses the process cartridge against the elastic supporting force to move the process cartridge from the positioning releasing position to the positioning position in the state in which the moving member has been moved in the inside position, the process cartridge comprising:

an electrophotographic photosensitive drum;

a process member acting on the electrophotographic photosensitive drum;

a positioned portion, which abuts against and is separated from the apparatus main body side positioning portion; and a supported portion elastically supported by a moving member side supporting portion of the supporting member.

* * * * *